US008721384B2

(12) United States Patent
Norman et al.

(10) Patent No.: US 8,721,384 B2
(45) Date of Patent: May 13, 2014

(54) DISPLAY CASE FOR VIBRATION POWERED DEVICE

(75) Inventors: David Anthony Norman, Greenville, TX (US); Robert H. Mimlitch, III, Rowlett, TX (US); Douglas Michael Galletti, Allen, TX (US); Joel Reagan Carter, Argyle, TX (US); Paul David Copioli, Greenville, TX (US)

(73) Assignee: Innovation First, Inc., Greenville, TX (US)

( * ) Notice: Subject to any disclaimer, the term of this patent is extended or adjusted under 35 U.S.C. 154(b) by 707 days.

(21) Appl. No.: 12/890,190

(22) Filed: Sep. 24, 2010

(65) Prior Publication Data

US 2011/0111671 A1 May 12, 2011

Related U.S. Application Data

(63) Continuation-in-part of application No. 12/860,696, filed on Aug. 20, 2010, and a continuation-in-part of application No. 12/872,209, filed on Aug. 31, 2010.

(60) Provisional application No. 61/246,023, filed on Sep. 25, 2009.

(51) Int. Cl.
*A63H 11/02* (2006.01)
*A63H 33/00* (2006.01)

(52) U.S. Cl.
USPC ..... 446/75; 446/73; 446/3

(58) Field of Classification Search
USPC ..... 446/3, 71, 75, 353, 409, 73; 206/579, 206/736, 767, 769
See application file for complete search history.

(56) References Cited

U.S. PATENT DOCUMENTS

| | | | | |
|---|---|---|---|---|
| 1,544,568 | A | 7/1925 | Fehr | |
| 1,793,121 | A | 7/1928 | Muller | |
| 1,763,788 | A | 6/1930 | Jobe, Sr. | |
| 2,138,280 | A * | 11/1938 | Kyser | 446/385 |
| 2,167,985 | A | 8/1939 | Levay | |

(Continued)

FOREIGN PATENT DOCUMENTS

| | | |
|---|---|---|
| CN | 1053896 | 8/1991 |
| CN | 2 820 261 | 9/2006 |

(Continued)

OTHER PUBLICATIONS

Office Action dated Feb. 8, 2013 in corresponding European Application No. 12163857.1, 8 pages.

(Continued)

*Primary Examiner* — Gene Kim
*Assistant Examiner* — Alyssa Hylinski
(74) *Attorney, Agent, or Firm* — Adam K. Sacharoff; Much Shelist

(57) ABSTRACT

An apparatus includes a fixed base, a platform supported by the fixed base, and a mechanism for causing vibration coupled to the platform and adapted to induce vibration of the platform sufficient to cause a vibration-powered vehicle to move across the platform without relying on an internal power supply of the vehicle. In some cases, a substantially planar cover is situated approximately parallel to the platform and spaced apart from the platform at a great enough distance to allow the vibration-powered vehicle to move across the platform and at a low enough distance to deter the vibration-powered vehicle from turning over.

10 Claims, 19 Drawing Sheets

(56) References Cited

U.S. PATENT DOCUMENTS

| | | | | |
|---|---|---|---|---|
| 2,618,888 | A | 11/1952 | Hoff | |
| 2,827,735 | A | 3/1958 | Grimm | |
| 2,862,333 | A | 12/1958 | Franco | |
| 2,919,921 | A * | 1/1960 | Berger | 273/145 D |
| 3,011,787 | A * | 12/1961 | Modica, Jr. et al. | 463/65 |
| 3,196,580 | A | 7/1965 | Rakestraw | |
| 3,331,463 | A | 7/1967 | Kramer | |
| 3,343,793 | A | 9/1967 | Waser | |
| 3,530,617 | A | 9/1970 | Halvorson et al. | |
| 3,590,522 | A * | 7/1971 | Hamano | 104/138.1 |
| 3,712,541 | A | 1/1973 | Merino et al. | |
| 3,841,636 | A * | 10/1974 | Meyer | 273/110 |
| 3,842,532 | A | 10/1974 | Nielsen | |
| 3,959,920 | A | 6/1976 | Ieda | |
| 4,085,539 | A * | 4/1978 | Hanson | 446/3 |
| 4,163,558 | A | 8/1979 | Breslow et al. | |
| 4,183,173 | A | 1/1980 | Ogawa | |
| 4,219,957 | A * | 9/1980 | Kakuta | 446/230 |
| 4,291,490 | A | 9/1981 | Ikeda | |
| 4,496,100 | A | 1/1985 | Schwager et al. | |
| 4,544,094 | A | 10/1985 | Scholey | |
| 4,550,910 | A | 11/1985 | Goldfarb et al. | |
| 4,591,346 | A | 5/1986 | Ikeda | |
| 4,605,230 | A | 8/1986 | Halford et al. | |
| 4,674,949 | A | 6/1987 | Kroczynski | |
| 4,708,690 | A | 11/1987 | Kulesza et al. | |
| 4,824,415 | A | 4/1989 | Herbstler et al. | |
| 4,941,857 | A | 7/1990 | Fujimaki | |
| 5,088,949 | A | 2/1992 | Atkinson et al. | |
| 5,162,009 | A * | 11/1992 | Vaughn | 463/60 |
| 5,221,226 | A | 6/1993 | Park | |
| 5,679,047 | A * | 10/1997 | Engel | 446/3 |
| 5,718,335 | A * | 2/1998 | Boudreaux | 206/461 |
| 5,947,788 | A | 9/1999 | Derrah | |
| 5,993,286 | A | 11/1999 | Tacquard et al. | |
| 6,155,905 | A | 12/2000 | Truax | |
| 6,199,439 | B1 | 3/2001 | Lin | |
| 6,238,264 | B1 | 5/2001 | Kazami et al. | |
| D458,320 | S | 6/2002 | Domingues | |
| 6,409,568 | B1 * | 6/2002 | Søgaard et al. | 446/73 |
| 6,435,929 | B1 | 8/2002 | Halford | |
| 6,450,104 | B1 | 9/2002 | Grant et al. | |
| 6,547,630 | B2 | 4/2003 | Beaman | |
| 6,599,048 | B2 | 7/2003 | Kuo | |
| 6,652,352 | B1 | 11/2003 | MacArthur et al. | |
| 6,826,449 | B1 | 11/2004 | Abu-Taha | |
| 6,866,557 | B2 | 3/2005 | Randall | |
| 6,899,589 | B1 | 5/2005 | Lund et al. | |
| 6,964,572 | B2 | 11/2005 | Cesa | |
| 7,025,656 | B2 | 4/2006 | Bailey | |
| 7,040,951 | B2 | 5/2006 | Hornsby et al. | |
| 7,339,340 | B2 | 3/2008 | Summer et al. | |
| 7,803,031 | B1 | 9/2010 | Winckler et al. | |
| 7,927,170 | B2 | 4/2011 | Bickerton et al. | |
| 8,038,503 | B2 | 10/2011 | Norman et al. | |
| 8,210,896 | B2 * | 7/2012 | Wittenberg | 446/297 |
| 8,371,896 | B2 * | 2/2013 | Baytman et al. | 446/175 |
| 2001/0024925 | A1 | 9/2001 | Domingues | |
| 2001/0054518 | A1 | 12/2001 | Buehler et al. | |
| 2002/0106624 | A1 * | 8/2002 | Chan | 434/393 |
| 2004/0198159 | A1 | 10/2004 | Xu et al. | |
| 2005/0112992 | A1 | 5/2005 | Malcolm | |
| 2005/0284788 | A1 * | 12/2005 | Elliott et al. | 206/461 |
| 2006/0076735 | A1 | 4/2006 | Proch et al. | |
| 2007/0087654 | A1 | 4/2007 | Chernick et al. | |
| 2007/0217644 | A1 * | 9/2007 | LeDonne | 381/396 |
| 2008/0061644 | A1 | 3/2008 | Treat | |
| 2009/0311941 | A1 | 12/2009 | Bickerton et al. | |
| 2012/0100777 | A1 | 4/2012 | Hsu | |

FOREIGN PATENT DOCUMENTS

| | | | |
|---|---|---|---|
| DE | 916 935 | | 8/1954 |
| DE | 11 20 958 | | 12/1961 |
| EP | 0008676 | | 3/1980 |
| FR | 1564711 | | 4/1969 |
| FR | 2 348 723 | | 11/1977 |
| FR | 2358174 | | 2/1978 |
| GB | 488042 | A | 6/1938 |
| GB | 1180384 | A | 2/1970 |
| GB | 1 291 592 | | 10/1972 |
| GB | 1 381 326 | | 1/1975 |
| GB | 1 595 007 | | 8/1981 |
| GB | 2427529 | | 12/2006 |
| JP | 1146570 | A | 6/1989 |
| JP | 04030883 | | 2/1992 |
| JP | 6343767 | | 12/1994 |
| KR | 20070101487 | | 10/2007 |
| WO | WO03/015891 | | 12/2003 |
| WO | 2006/136792 | A1 | 12/2006 |
| WO | WO 2011/038280 | | 3/2011 |
| WO | WO 2011/038281 | | 3/2011 |

OTHER PUBLICATIONS

Office Action issued in U.S. Appl. No. 12/872,850 on Nov. 26, 2012, 15 pages.

Office Action issued in U.S. Appl. No. 13/433,758 on Feb. 21, 2013, 17 pages.

Office Action dated Feb. 5, 2013 in corresponding Chinese Application No. 201080001432.4, 25 pages.

RC Bristlebot, http://blog.makezine.com/archive/2008/04/rc_bristlebot.html, Aug. 30, 2010.

Publisher Klutz Lives Up to Its Name: "Bristlebots," Scholastic, and Evil Mad Scientist Lab http://boingboing.net/2009/02/20/publisher-klutz-live.html, Xeni Jardin at 9:06 am, Feb. 20, 2009.

Vibrobot, "Make a Twitchy, Bug-Like Robot with a Toy Motor and a Mint Tin" http://makezine.com/10/123_vibrobot/, 2007.

Vibrobot, "How to—Make a Bristlebot a Tiny Directional Vibrobot Made from a Toothbrush!" http://blog.makezine.com/archive/2007/12/how_to_make_a_bristlebot.html, 2007.

BotJunkie,DIY Vibrobots, http:www.botjunkie.com/2007/12/20/diy-vibrobots/, 2007.

Notification of Transmittal of the International Search Report and the Written Opinion of the International Searching Authority, or Declaration (1 page); International Search Report (2 pages); and Written Opinion of the International Searching Authority (29 pages), mailed Nov. 22, 2010, for related international application PCT/US2010/050238.

David Anthony Norman et al., "Vibration Powered Toy" Office Action dated Oct. 28, 2010 in corresponding Australian application No. 2010224405.

http://www.evilmadscientist.com/article.com/bristlebot, Oskay, Dec. 19, 2007.

http://www.youtube.com/watch?v=h6jowo3OxAQ, Innovation First, Sep. 18, 2009.

Notification of Transmittal of the International Search Report and the Written Opinion of the International Searching Authority, or Declaration (1 page); International Search Report (5 pages); and Written Opinion of the International Searching Authority (6 pages), mailed Jan. 26, 2011, for related international application PCT/US2010/050256.

Notification of Transmittal of the International Search Report and the Written Opinion of the International Searching Authority, or Declaration (1 page); International Search Report (4 pages); and Written Opinion of the International Searching Authority (6 pages), mailed Feb. 14, 2011, for related international application PCT/US2010/050261.

Notification of Transmittal of the International Search Report and the Written Opinion of the International Searching Authority, or Declaration (1 page); International Search Report (4 pages); and Written Opinion of the International Searching Authority (6 pages), mailed Feb. 15, 2011, for related international application PCT/US2010/050265.

(56) References Cited

OTHER PUBLICATIONS

Notification of Transmittal of the International Search Report and the Written Opinion of the International Searching Authority, or Declaration (1 page); International Search Report (4 pages); and Written Opinion of the International Searching Authority (6 pages), mailed Feb. 3, 2011, for related international application PCT/US2010/050258.
Notification of Transmittal of the International Search Report and the Written Opinion of the International Searching Authority, or Declaration (1 page); International Search Report (4 pages); and Written Opinion of the International Searching Authority (7 pages), mailed Feb. 3, 2011, for related international application PCT/US2010/050281.
Notification of Transmittal of the International Search Report and the Written Opinion of the International Searching Authority, or Declaration (1 page); International Search Report (4 pages); and Written Opinion of the International Searching Authority (6 pages), mailed Feb. 3, 2011, for related international application PCT/US2010/050266.
http://www.klutz.com/Invasion-of-the-Bristlebots, [online] Invasion of the Bristlebots, 8 pages, [retrieved Oct. 20, 2010].
http://www.streettech.com/modules, [online] How-To: Build BEAM Vibrobots, Street Tech, Hardware beyond the hype, 7 pages [Retrieved Oct. 20, 2010].
http://www.evilmadscientist/.com/article.php/bristlebot, [online] Bristlebot: A tiny directional vibrobot—Evil Mad Scientist Laboratories, 21 pages, [Retrieved Oct. 20, 2010].
http://themombuzz.mom/2009/12/11/stocking-stuffer-nascar-zipbot-race-set [on line] Stocking Stuffer: NASCAR Zipbot Race Set: The Mom Buzz, 10 pages, [Retrieved Oct. 20, 2010].
RC Bristlebot, http://blog.makezine.com.archive/2008/04/rc_bristlebot.html, Aug. 30, 2010.
Vibrobot, "Make a Twitchy, Bug-Like Robot with a Toy Motor and a Mint Tin" http//:makezine.com/10/123_vibrobotl, 2007.
BotJunkie,DIY Vibrobots, http://www.botjunkie.com/2007/12/20/diy-vibrobots/, 2007.
http://www.evilmadscientist.com/article.php/bristlebot, Oskay, Dec. 19, 2007.
David Anthony Norman et al., "Vehicle, in Particular, a Toy Robot with Vibrating Motor" EPO Search Report dated Jan. 27, 2011 in corresponding European application No. 10179680.3, 3 pages.
David Anthony Norman et al., "Vehicle, in Particular, a Toy Robot with Vibrating Motor" EPO Communication dated Feb. 10, 2011 in corresponding European application No. 10179680.3, 5 pages.
David Anthony Norman et al., "Vehicle, in Particular, a Toy Robot with Vibrating Motor" EPO Search Report dated Feb. 3, 2011 in corresponding European application No. 10179686.0, 3 pages.
David Anthony Norman et al., "Vehicle, in Particular, a Toy Robot with Vibrating Motor" EPO Search Report dated Feb. 3, 2011 in corresponding European application No. 10179694.4, 3 pages.
David Anthony Norman et al., "Vehicle, in Particular, a Toy Robot with Vibrating Motor" EPO Search Report dated Feb. 3, 2011 in corresponding European application No. 10179701.7 , 3 pages.
David Anthony Norman et al., "Vehicle, in Particular, a Toy Robot with Vibrating Motor" EPO Search Report dated Feb. 3, 2011 in corresponding European application No. 10179706.6 , 3 pages.
David Anthony Norman et al., "Vehicle, in Particular, a Toy Robot with Vibrating Motor" EPO Search Report dated Feb. 15, 2011 in corresponding European application No. 10179707.4 , 3 pages.
Notification of Transmittal of the International Search Report and the Written Opinion of the International Searching Authority, or Declaration (1 page); International Search Report (4 pages); and Written Opinion of the International Searching Authority (5 pages), mailed Jun. 7, 2012, for related international application PCT/US2012/027914.
EPO Office Communication dated Jul. 23, 2012 in corresponding European application No. 12163857.1, 5 pages.
EPO Office Communication dated Jul. 23, 2012 in corresponding European application No. 12166840.4, 3 pages.
EPO Office Communication dated Mar. 31, 2011 in corresponding European application No. 10179686.0, 5 pages.
EPO Office Communication dated Mar. 31, 2011 in corresponding European application No. 10179694.4, 5 pages.
EPO Office Communication dated Mar. 31, 2011 in corresponding European application No. 10179701.7 , 5 pages.
EPO Office Communication dated Mar. 31, 2011 in corresponding European application No. 10179706.6 , 4 pages.
EPO Office Communication dated Mar. 31, 2011 in corresponding European application No. 10179707.4 , 4 pages.
Notification of Transmittal of the International Search Report and the Written Opinion of the International Searching Authority, or Declaration (1 page); International Search Report (7 pages); and Written Opinion of the International Searching Authority (10 pages), mailed Apr. 14, 2011, for related international application PCT/US2010/050279.
Notification of Transmittal of the International Search Report and the Written Opinion of the International Searching Authority, or Declaration (1 page); International Search Report (7 pages); and Written Opinion of the International Searching Authority (10 pages), mailed Mar. 25, 2011, for related international application PCT/US2010/050257.
Office Action dated Jul. 16, 2012 in corresponding Australian application No. 2012201317, 3 pages.
Office Action dated Aug. 3, 2012 in corresponding Chinese application No. 201080001431.X, 18 pages.
GreenbergTraurig Letter dated Aug. 10, 2012 (2 pages).
*Innovation First, Inc., and Innovation First Labs, Inc.* v. *Toy Investment, Inc. D/B/A Toysmith, and McManemin Companies,* Civil Action No. 3:12-CV-02091-M, Plaintiffs' Answer to Defendants' Counterclaims, Filed Sep. 13, 2012 (5 pages).
*Innovation First, Inc., and Innovation First Labs, Inc.* v. *Toy Investment, Inc. D/B/A Toysmith, and McManemin Companies,* Civil Action No. 3:12-CV-02091-M, Answer to Complaint, Filed Aug. 20, 2012 (7 pages).
*Innovation First, Inc., and Innovation First Labs, Inc.* v. *Toy Investment, Inc. D/B/A Toysmith, and McManemin Companies,* Civil Action No. 3:12-CV-02091-M, Plaintiffs' Complaint for Patent Infringement, Filed Jun. 29, 2012 (45 pages).
Davis Wright Tremaine LLP Letter dated Aug. 1, 2012 (3 pages).
Search Report dated Sep. 20, 2011 in corresponding German application No. 102010046513.5, 5 pages.
Search Report dated Sep. 20, 2011 in corresponding German application No. 102010046511.9, 5 pages.
Search Report dated Sep. 20, 2011 in corresponding German application No. 102010046509.7, 5 pages.
Search Report dated Sep. 20, 2011 in corresponding German application No. 102010046440.6, 5 pages.
Search Report dated Sep. 20, 2011 in corresponding German application No. 102010046510.0, 5 pages.
Search Report dated Sep. 20, 2011 in corresponding German application No. 102010046441.4, 5 pages.
Search Report dated Jul. 5, 2012 in corresponding European application No. 12163857.1, 3 pages.

* cited by examiner

DISPLAY CASE FOR VIBRATION POWERED DEVICE

CROSS-REFERENCE TO RELATED APPLICATIONS

This application claims the benefit under 35 U.S.C. §119 (e) of U.S. patent application Ser. No. 61/246,023, entitled "Vibration Powered Vehicle," filed Sep. 25, 2009, which is incorporated herein by reference in its entirety. This application also is a continuation-in-part and claims the benefit under 35 U.S.C. §120 of U.S. patent application Ser. No. 12/860,696, entitled "Vibration Powered Vehicle," filed Aug. 20, 2010, which is incorporated herein by reference in its entirety and is a continuation-in-part and claims the benefit under 35 U.S.C. §120 of U.S. patent application Ser. No. 12/872,209, entitled "Vibration Powered Toy," filed Aug. 31, 2010, which is incorporated herein by reference in its entirety.

BACKGROUND

This specification relates to display cases for devices that move based on oscillatory motion and/or vibration.

One example of vibration driven movement is a vibrating electric football game. A vibrating horizontal metal surface induced inanimate plastic figures to move randomly or slightly directionally. More recent examples of vibration driven motion use internal power sources and a vibrating mechanism located on a vehicle.

One method of creating movement-inducing vibrations is to use rotational motors that spin a shaft attached to a counterweight. The rotation of the counterweight induces an oscillatory motion. Power sources include wind up springs that are manually powered or DC electric motors. The most recent trend is to use pager motors designed to vibrate a pager or cell phone in silent mode. Vibrobots and Bristlebots are two modern examples of vehicles that use vibration to induce movement. For example, small, robotic devices, such as Vibrobots and Bristlebots, can use motors with counterweights to create vibrations. The robots' legs are generally metal wires or stiff plastic bristles. The vibration causes the entire robot to vibrate up and down as well as rotate. These robotic devices tend to drift and rotate because no significant directional control is achieved.

Vibrobots tend to use long metal wire legs. The shape and size of these vehicles vary widely and typically range from short 2" devices to tall 10" devices. Rubber feet are often added to the legs to avoid damaging tabletops and to alter the friction coefficient. Vibrobots typically have 3 or 4 legs, although designs with 10-20 exist. The vibration of the body and legs creates a motion pattern that is mostly random in direction and in rotation. Collision with walls does not result in a new direction and the result is that the wall only limits motion in that direction. The appearance of lifelike motion is very low due to the highly random motion.

Bristlebots are sometimes described in the literature as tiny directional Vibrobots. Bristlebots use hundreds of short nylon bristles for legs. The most common source of the bristles, and the vehicle body, is to use the entire head of a toothbrush. A pager motor and battery complete the typical design. Motion can be random and directionless depending on the motor and body orientation and bristle direction. Designs that use bristles angled to the rear with an attached rotating motor can achieve a general forward direction with varying amounts of turning and sideways drifting. Collisions with objects such as walls cause the vehicle to stop, then turn left or right and continue on in a general forward direction. The appearance of lifelike motion is minimal due to a gliding movement and a zombie-like reaction to hitting a wall.

SUMMARY

In general, one innovative aspect of the subject matter described in this specification can be embodied in apparatus capable of causing movement of a vibration-powered vehicle, where the apparatus include a fixed base, a platform supported by the fixed base, a mechanism for causing vibration coupled to the platform and adapted to induce vibration of the platform sufficient to cause a vibration-powered vehicle to move across the platform, and a substantially planar cover situated approximately parallel to the platform and spaced apart from the platform at a great enough distance to allow the vibration-powered vehicle to move across the platform and at a low enough distance to deter the vibration-powered vehicle from turning over.

These and other embodiments can each optionally include one or more of the following features. The mechanism for causing vibration includes a speaker, and the apparatus further includes a power source, an energy transfer ring coupled to the speaker, and a stiffener coupled to the energy transfer ring. The platform is coupled to the stiffener and is configured to support the vibration-powered vehicle and at least one obstacle. The power source includes AC power or a battery. The power source provides power to the speaker at an amplitude within a range of 4 to 10 volts peak to peak (e.g., approximately 5 volts peak to peak). The apparatus is adapted to consumes less than about 20 milliamps. The apparatus is tuned such that a frequency of the speaker is selected to approximately match a motor rotation frequency of the vibration-powered vehicle. The frequency of the speaker is in the range of 40 to 200 Hertz to induce motion of the vibration-powered vehicle. The apparatus includes a switch for controlling power supplied to the speaker. The planar cover is substantially transparent.

In general, another aspect of the subject matter described in this specification can be embodied in methods that include the acts of placing a vibration-powered vehicle on a platform that is coupled to a mechanism for causing vibration and activating the mechanism for causing vibration. The mechanism for causing vibration is supported by a fixed base, and the vibration-powered vehicle includes a self-contained vibration-inducing mechanism. Vibration of the platform induces sufficient vibration of the vibration-powered vehicle to cause the vibration-powered vehicle to move across the platform without activation of the self-contained vibration-inducing mechanism.

These and other embodiments can each optionally include one or more of the following features. The self-contained vibration-inducing mechanism includes a rotational motor coupled to an eccentric load. The platform is enclosed with a substantially planar cover situated approximately parallel to the platform and spaced apart from the platform at a great enough distance to allow the vibration-powered vehicle to move across the platform and at a low enough distance to deter the vibration-powered vehicle from turning over. Power is provided to the mechanism for causing vibration using a power source. The mechanism for causing vibration includes a speaker. An oscillation frequency of the speaker is adjusted to substantially match a motor rotation frequency of the vibration-powered vehicle. The self-contained vibration-inducing mechanism includes a rotational motor and an eccentric load, and the rotational motor is adapted to rotate the eccentric load. The vibration-powered device further includes a body coupled to the rotational motor and a plurality of legs each having a leg base and a leg tip at a distal end relative to the leg base. At least a portion of the plurality of legs are constructed from a flexible material, injection molded, integrally coupled to the body at the leg base, and include at least one driving leg configured to cause the vibration-powered device to move in a direction generally defined by an offset between the leg base and the leg tip as the rotational motor rotates the eccentric load.

In general, another aspect of the subject matter described in this specification can be embodied in apparatus that include a fixed base, a platform attached to the fixed base that is adapted to support at least one vibration-powered vehicle, a conductive coil connected to a power source and positioned under at least a substantial portion surface of the platform. The conductive coil is adapted to provide power to a conductive coil connected to a battery of the at least one vibration-powered vehicle.

These and other embodiments can each optionally include one or more of the following features. A button can be used to activate the power source. At least one obstacle can be situated on the platform. A substantially planar cover is situated approximately parallel to the platform and spaced apart from the platform at a great enough distance to allow the at least one vibration-powered vehicle to move across the platform and at a low enough distance to deter the at least one vibration-powered vehicle from turning over.

In general, another aspect of the subject matter described in this specification can be embodied in methods that include the acts of supporting a platform on a fixed base, supporting a vibration-powered device on the platform, and providing power to the vibration-powered device using a conductive coil connected to a power source. The conductive coil is positioned under at least a portion of a surface of the platform and is adapted to provide power to a conductive coil connected to the vibration-powered device.

These and other embodiments can each optionally include one or more of the following features. A battery on the vibration-powered device is charged using the conductive coil connected to the power source and the conductive coil connected to the vibration-powered device.

In general, another aspect of the subject matter described in this specification can be embodied in apparatus that include a fixed base, a platform supported by the fixed base, and a speaker coupled to the platform and adapted to induce vibration of the platform sufficient to cause a vibration-powered vehicle to move across the platform.

The details of one or more embodiments of the subject matter described in this specification are set forth in the accompanying drawings and the description below. Other features, aspects, and advantages of the subject matter will become apparent from the description, the drawings, and the claims.

BRIEF DESCRIPTION OF THE DRAWINGS

Like reference numbers and designations in the various drawings indicate like elements.

DETAILED DESCRIPTION

Figure 1:
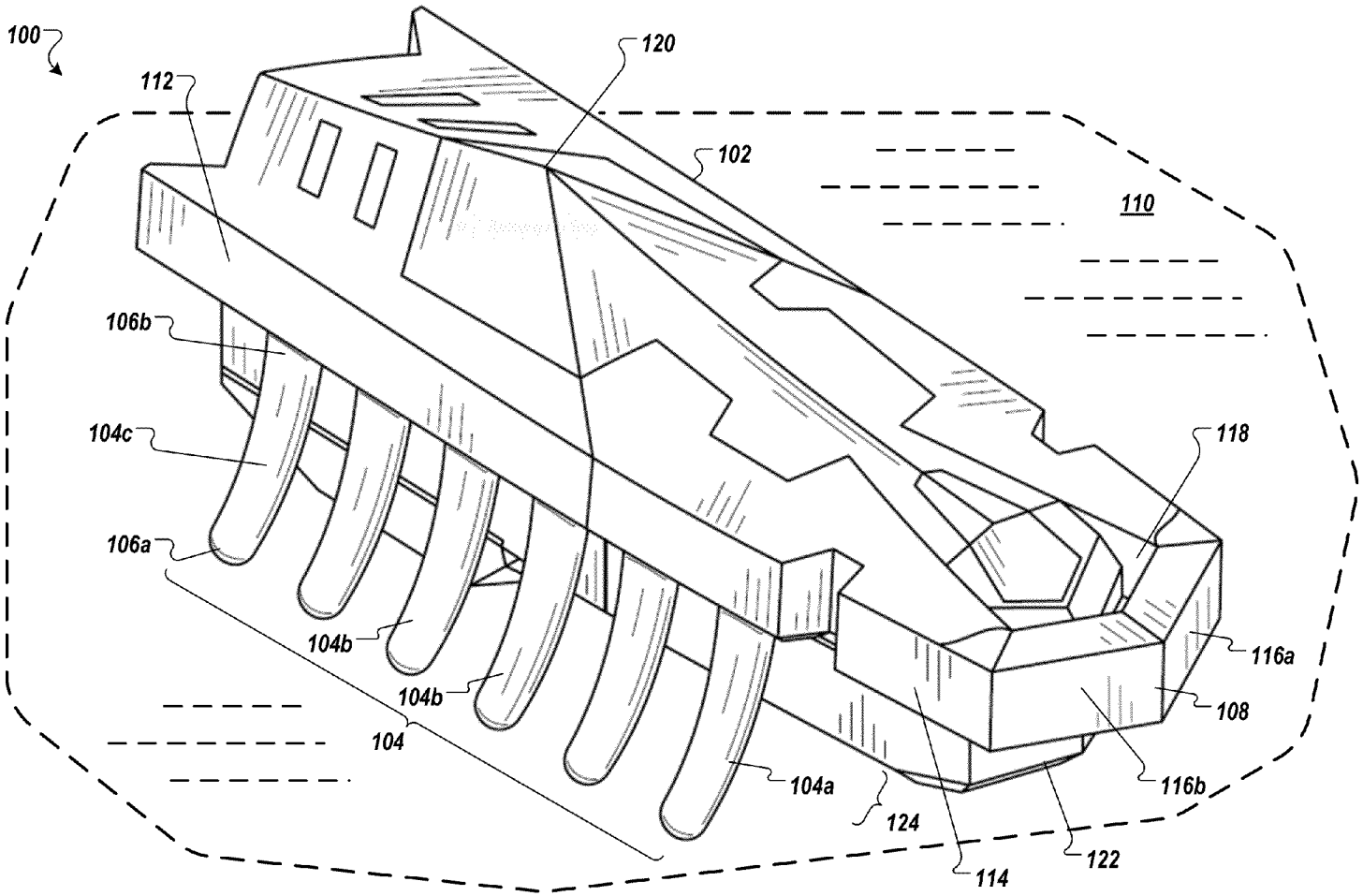
FIG. 1 is a diagram that illustrates an example vibration powered device.

Small robotic devices, or vibration-powered vehicles, can be designed to move across a surface, e.g., a floor, table, or other relatively flat surface. The robotic device is adapted to move autonomously and, in some implementations, turn in seemingly random directions. In general, the robotic devices include a housing, multiple legs, and a vibrating mechanism (e.g., a motor or spring-loaded mechanical winding mechanism rotating an eccentric load, a motor or other mechanism adapted to induce oscillation of a counterweight, or other arrangement of components adapted to rapidly alter the center of mass of the device). As a result, the miniature robotic devices, when in motion, can resemble organic life, such as bugs or insects.

Movement of the robotic device can be induced by the motion of a rotational motor inside of, or attached to, the device, in combination with a rotating weight with a center of mass that is offset relative to the rotational axis of the motor. The rotational movement of the weight causes the motor and the robotic device to which it is attached to vibrate. In some implementations, the rotation is approximately in the range of 6000-9000 revolutions per minute (rpm's), although higher or lower rpm values can be used. As an example, the device can use the type of vibration mechanism that exists in many pagers and cell phones that, when in vibrate mode, cause the pager or cell phone to vibrate. The vibration induced by the vibration mechanism can cause the device to move across the surface (e.g., the floor) using legs that are configured to alternately flex (in a particular direction) and return to the original position as the vibration causes the device to move up and down.

Various features can be incorporated into the robotic devices. For example, various implementations of the devices can include features (e.g., shape of the legs, number of legs, frictional characteristics of the leg tips, relative stiffness or flexibility of the legs, resiliency of the legs, relative location of the rotating counterweight with respect to the legs, etc.) for facilitating efficient transfer of vibrations to forward motion. The speed and direction of the robotic device's movement can depend on many factors, including the rotational speed of the motor, the size of the offset weight attached to the motor, the power supply, the characteristics (e.g., size, orientation, shape, material, resiliency, frictional characteristics, etc.) of the "legs" attached to the housing of the device, the properties of the surface on which the device operates, the overall weight of the device, and so on.

In some implementations, the devices include features that are designed to compensate for a tendency of the device to turn as a result of the rotation of the counterweight and/or to alter the tendency for, and direction of, turning between different robotic devices. The components of the device can be positioned to maintain a relatively low center of gravity (or center of mass) to discourage tipping (e.g., based on the lateral distance between the leg tips) and to align the components with the rotational axis of the rotating motor to encourage rolling (e.g., when the device is not upright). Likewise, the device can be designed to encourage self-righting based on features that tend to encourage rolling when the device is on its back or side in combination with the relative flatness of the device when it is upright (e.g., when the device is "standing" on its leg tips). Features of the device can also be used to increase the appearance of random motion and to make the device appear to respond intelligently to obstacles. Different leg configurations and placements can also induce different types of motion and/or different responses to vibration, obstacles, or other forces. Moreover, adjustable leg lengths can be used to provide some degree of steering capability. In some implementations, the robotic devices can simulate real-life objects, such as crawling bugs, rodents, or other animals and insects.

FIG. 1 is a diagram that illustrates an example device 100 that is shaped like a bug. The device 100 includes a housing 102 (e.g., resembling the body of the bug) and legs 104. Inside (or attached to) the housing 102 are the components that control and provide movement for the device 100, including a rotational motor, power supply (e.g., a battery), and an on/off switch. Each of the legs 104 includes a leg tip 106*a* and a leg base 106*b*. The properties of the legs 104, including the position of the leg base 106*b* relative to the leg tip 106*a*, can contribute to the direction and speed in which the device 100 tends to move. The device 100 is depicted in an upright position (i.e., standing on legs 104) on a supporting surface 110 (e.g., a substantially planar floor, table top, etc. that counteracts gravitational forces).

Overview of Legs

Legs 104 can include front legs 104*a*, middle legs 104*b*, and rear legs 104*c*. For example, the device 100 can include a pair of front legs 104*a* that may be designed to perform differently from middle legs 104*b* and rear legs 104*c*. For example, the front legs 104*a* may be configured to provide a driving force for the device 100 by contacting an underlying surface 110 and causing the device to hop forward as the device vibrates. Middle legs 104*b* can help provide support to counteract material fatigue (e.g., after the device 100 rests on the legs 104 for long periods of time) that may eventually cause the front legs 104*a* to deform and/or lose resiliency. In some implementations, device 100 can exclude middle legs 104*b* and include only front legs 104*a* and rear legs 104*c*. In some implementations, front legs 104*a* and one or more rear legs 104*c* can be designed to be in contact with a surface, while middle legs 104*b* can be slightly off the surface so that the middle legs 104*b* do not introduce significant additional drag forces and/or hopping forces that may make it more difficult to achieve desired movements (e.g., tendency to move in a relatively straight line and/or a desired amount of randomness of motion).

In some implementations, the device 100 can be configured such that only two front legs 104*a* and one rear leg 104*c* are in contact with a substantially flat surface 110, even if the device includes more than one rear leg 104*c* and several middle legs 104*b*. In other implementations, the device 100 can be configured such that only one front leg 104*a* and two rear legs 104*c* are in contact with a flat surface 110. Throughout this specification, descriptions of being in contact with the surface can include a relative degree of contact. For example, when one or more of the front legs 104*a* and one or more of the back legs 104*c* are described as being in contact with a substantially flat surface 110 and the middle legs 104*b* are described as not being in contact with the surface 110, it is also possible that the front and back legs 104*a* and 104*c* can simply be sufficiently longer than the middle legs 104*b* (and sufficiently stiff) that the front and back legs 104*a* and 104*c* provide more support for the weight of the device 100 than do the middle legs 104*b*, even though the middle legs 104*b* are technically actually in contact with the surface 110. In some implementations, even legs that have a lesser contribution to support of the device may nonetheless be in contact when the device 100 is in an upright position, especially when vibration of the device causes an up and down movement that compresses and bends the driving legs and allows additional legs to contact the surface 110. Greater predictability and control of movement (e.g., in a straight direction) can be obtained by constructing the device so that a sufficiently small number of legs (e.g., fewer than twenty or fewer than thirty) contact the support surface 110 and/or contribute to the support of the device in the upright position when the device is either at rest or as the rotating eccentric load induces movement. In this respect, it is possible for some legs to provide support even without contacting the support surface 110 (e.g., one or more short legs can provide stability by contacting an adjacent longer leg to increase overall stiffness of the adjacent longer leg). Typically, however, each leg is sufficiently stiff that four or fewer legs are capable of supporting the weight of the device without substantial deformation (e.g., less than 5% as a percentage of the height of the leg base 106*b* from the support surface 110 when the device 100 is in an upright position).

Different leg lengths can be used to introduce different movement characteristics, as further discussed below. The various legs can also include different properties, e.g., different stiffnesses or coefficients of friction, as further described below. Generally, the legs can be arranged in substantially parallel rows along each lateral side of the device 100 (e.g., FIG. 1 depicts one row of legs on the right lateral side of the device 100; a corresponding row of legs (not shown in FIG. 1) can be situated along the left lateral side of the device 100).

In general, the number of legs 104 that provide meaningful or any support for the device can be relatively limited. For example, the use of less than twenty legs that contact the support surface 110 and/or that provide support for the device 100 when the device 100 is in an upright position (i.e., an orientation in which the one or more driving legs 104*a* are in contact with a support surface) can provide more predictability in the directional movement tendencies of the device 100 (e.g., a tendency to move in a relatively straight and forward direction), or can enhance a tendency to move relatively fast by increasing the potential deflection of a smaller number of legs, or can minimize the number of legs that may need to be altered to achieve the desired directional control, or can improve the manufacturability of fewer legs with sufficient spacing to allow room for tooling. In addition to providing support by contacting the support surface 110, legs 104 can provide support by, for example, providing increased stability for legs that contact the surface 110. In some implementations, each of the legs that provides independent support for the device 100 is capable of supporting a substantial portion of the weight of the device 100. For example, the legs 104 can be sufficiently stiff that four or fewer legs are capable of statically (e.g., when the device is at rest) supporting the device without substantial deformation of the legs 104 (e.g., without causing the legs to deform such that the body of the device 100 moves more than 5% as a percentage of the height of the leg base 106*b* from the support surface).

Figure 4:
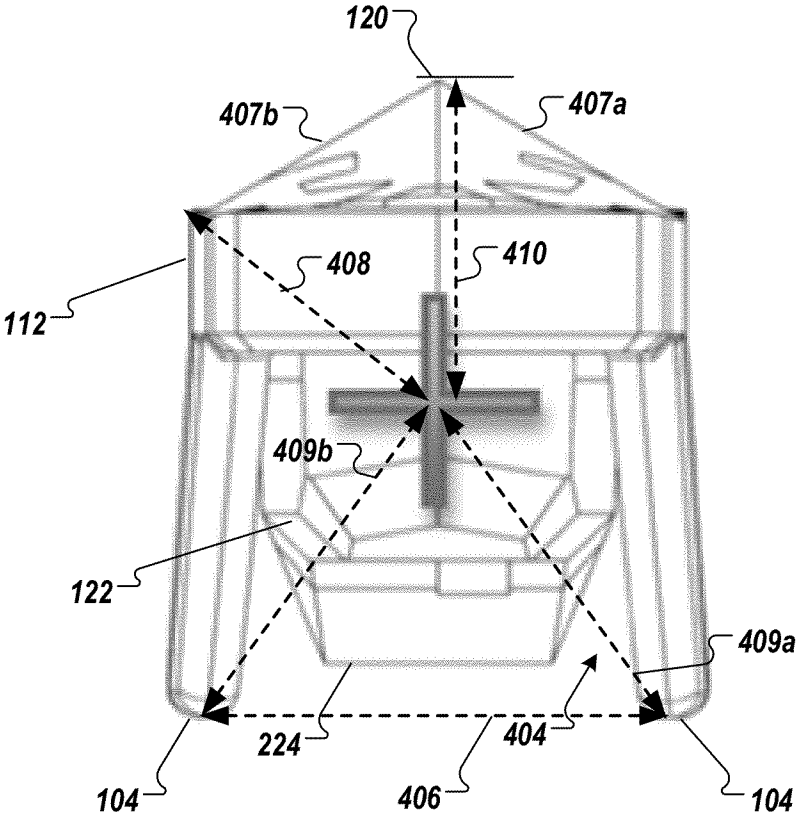
FIG. 4 shows an example front view indicating a center of gravity for the device.

As described here at a high level, many factors or features can contribute to the movement and control of the device 100. For example, the device's center of gravity (CG), and whether it is more forward or towards the rear of the device, can influence the tendency of the device 100 to turn. Moreover, a lower CG can help to prevent the device 100 from tipping over. The location and distribution of the legs 104 relative to the CG can also prevent tipping. For example, if pairs or rows of legs 104 on each side of the device 100 are too close together and the device 100 has a relatively high CG (e.g., relative to the lateral distance between the rows or pairs of legs), then the device 100 may have a tendency to tip over on its side. Thus, in some implementations, the device includes rows or pairs of legs 104 that provide a wider lateral stance (e.g., pairs of front legs 104*a*, middle legs 104*b*, and rear legs 104*c* are spaced apart by a distance that defines an approximate width of the lateral stance) than a distance between the CG and a flat supporting surface on which the device 100 rests in an upright position. For example, the distance between the CG and the supporting surface can be in the range of 50-80% of the value of the lateral stance (e.g., if the lateral stance is 0.5 inches, the CG may be in the range of 0.25-0.4 inches from the surface 110). Moreover, the vertical location of the CG of the device 100 can be within a range of 40-60% of the distance between a plane that passes through the leg tips 106*a* and the highest protruding surface on the top side of the housing 102. In some implementations, a distance 409*a* and 409*b* (as shown in FIG. 4) between each row of the tips of legs 104 and a longitudinal axis of the device 100 that runs through the CG can be roughly the same or less than the distance 406 (as shown in FIG. 4) between the tips 106*a* of two rows of legs 104 to help facilitate stability when the device is resting on both rows of legs.

The device 100 can also include features that generally compensate for the device's tendency to turn. Driving legs (e.g., front legs 104*a*) can be configured such that one or more legs on one lateral side of the device 100 can provide a greater driving force than one or more corresponding legs on the other lateral side of the device 100 (e.g., through relative leg lengths, relative stiffness or resiliency, relative fore/aft location in the longitudinal direction, or relative lateral distance from the CG). Similarly, dragging legs (e.g., back legs 104*c*) can be configured such that one or more legs on one lateral side of the device 100 can provide a greater drag force than one or more corresponding legs on the other lateral side of the device 100 (e.g., through relative leg lengths, relative stiffness or resiliency, relative fore/aft location in the longitudinal direction, or relative lateral distance from the CG). In some implementations, the leg lengths can be tuned either during manufacturing or subsequently to modify (e.g., increase or reduce) a tendency of the device to turn.

Movement of the device can also be influenced by the leg geometry of the legs 104. For example, a longitudinal offset between the leg tip (i.e., the end of the leg that touches the surface 110) and the leg base (i.e., the end of the leg that attaches to the device housing) of any driving legs induces movement in a forward direction as the device vibrates. Including some curvature, at least in the driving legs, further facilitates forward motion as the legs tend to bend, moving the device forward, when vibrations force the device downward and then spring back to a straighter configuration as the vibrations force the device upward (e.g., resulting in hopping completely or partially off the surface, such that the leg tips move forward above or slide forward across the surface 110).

The ability of the legs to induce forward motion results in part from the ability of the device to vibrate vertically on the resilient legs. As shown in FIG. 1, the device 100 includes an underside 122. The power supply and motor for the device 100 can be contained in a chamber that is formed between the underside 122 and the upper body of the device, for example. The length of the legs 104 creates a space 124 (at least in the vicinity of the driving legs) between the underside 122 and the surface 110 on which the device 100 operates. The size of the space 124 depends on how far the legs 104 extend below the device relative to the underside 122. The space 124 provides room for the device 100 (at least in the vicinity of the driving legs) to move downward as the periodic downward force resulting from the rotation of the eccentric load causes the legs to bend. This downward movement can facilitate forward motion induced by the bending of the legs 104.

The device can also include the ability to self-right itself, for example, if the device 100 tips over or is placed on its side or back. For example, constructing the device 100 such that the rotational axis of the motor and the eccentric load are approximately aligned with the longitudinal CG of the device 100 tends to enhance the tendency of the device 100 to roll (i.e., in a direction opposite the rotation of the motor and the eccentric load). Moreover, construction of the device housing to prevent the device from resting on its top or side (e.g., using one or more protrusions on the top and/or sides of the device housing) and to increase the tendency of the device to bounce when on its top or side can enhance the tendency to roll. Furthermore, constructing the legs of a sufficiently flexible material and providing clearance on the housing undercarriage that the leg tips to bend inward can help facilitate rolling of the device from its side to an upright position.

FIG. 1 shows a body shoulder 112 and a head side surface 114, which can be constructed from rubber, elastomer, or other resilient material, contributing to the device's ability to self-right after tipping. The bounce from the shoulder 112 and the head side surface 114 can be significantly more than the lateral bounce achieved from the legs, which can be made of rubber or some other elastomeric material, but which can be less resilient than the shoulder 112 and the head side surface 114 (e.g., due to the relative lateral stiffness of the shoulder 112 and the head side surface 114 compared to the legs 104). Rubber legs 104, which can bend inward toward the body 102 as the device 100 rolls, increase the self-righting tendency, especially when combined with the angular/rolling forces induced by rotation of the eccentric load. The bounce from the shoulder 112 and the head side surface 114 can also allow the device 100 to become sufficiently airborne that the angular forces induced by rotation of the eccentric load can cause the device to roll, thereby facilitating self-righting.

The device can also be configured to include a degree of randomness of motion, which can make the device 100 appear to behave like an insect or other animate object. For example, vibration induced by rotation of the eccentric load can further induce hopping as a result of the curvature and "tilt" of the legs. The hopping can further induce a vertical acceleration (e.g., away from the surface 110) and a forward acceleration (e.g., generally toward the direction of forward movement of the device 100). During each hop, the rotation of the eccentric load can further cause the device to turn toward one side or the other depending on the location and direction of movement of the eccentric load. The degree of random motion can be increased if relatively stiffer legs are used to increase the amplitude of hopping. The degree of random motion can be influenced by the degree to which the rotation of the eccentric load tends to be either in phase or out of phase with the hopping of the device (e.g., out of phase rotation relative to hopping may increase the randomness of motion). The degree of random motion can also be influenced by the degree to which the back legs 104*c* tend to drag. For example, dragging of back legs 104*c* on both lateral sides of the device 100 may tend to keep the device 100 traveling in a more straight line, while back legs 104*c* that tend to not drag (e.g., if the legs bounce completely off the ground) or dragging of back legs 104*c* more on one side of the device 100 than the other can tend to increase turning.

Another feature is "intelligence" of the device 100, which can allow the device to interact in an apparently intelligent manner with obstacles, including, for example, bouncing off any obstacles (e.g., walls, etc.) that the device 100 encounters during movement. For example, the shape of the nose 108 and the materials from which the nose 108 is constructed can enhance a tendency of the device to bounce off of obstacles and to turn away from the obstacle. Each of these features can contribute to how the device 100 moves, and will be described below in more detail.

FIG. 1 illustrates a nose 108 that can contribute to the ability of the device 100 to deflect off of obstacles. Nose left side 116*a* and nose right side 116*b* can form the nose 108. The nose sides 116*a* and 116*b* can form a shallow point or another shape that helps to cause the device 100 to deflect off obstacles (e.g., walls) encountered as the device 100 moves in a generally forward direction. The device 100 can includes a space within the head 118 that increases bounce by making the head more elastically deformable (i.e., reducing the stiffness). For example, when the device 100 crashes nose-first into an obstacle, the space within the head 118 allows the head of the device 100 to compress, which provides greater control over the bounce of the device 100 away from the obstacle than if the head 118 is constructed as a more solid block of material. The space within the head 118 can also better absorb impact if the device falls from some height (e.g., a table). The body shoulder 112 and head side surface 114, especially when constructed from rubber or other resilient material, can also contribute to the device's tendency to deflect or bounce off of obstacles encountered at a relatively high angle of incidence.

Wireless/Remote Control Embodiments

In some implementations, the device 100 includes a receiver that can, for example, receive commands from a remote control unit. Commands can be used, for example, to control the device's speed and direction, and whether the device is in motion or in a motionless state, to name a few examples. In some implementations, controls in the remote control unit can engage and disengage the circuit that connects the power unit (e.g., battery) to the device's motor, allowing the operator of the remote control to start and stop the device 100 at any time. Other controls (e.g., a joy stick, sliding bar, etc.) in the remote control unit can cause the motor in the device 100 to spin faster or slower, affecting the speed of the device 100. The controls can send the receiver on the device 100 different signals, depending on the commands that correspond to the movement of the controls. Controls can also turn on and off a second motor attached to a second eccentric load in the device 100 to alter lateral forces for the device 100, thereby changing a tendency of the device to turn and thus providing steering control. Controls in a remote control unit can also cause mechanisms in the device 100 to lengthen or shorten one or more of the legs and/or deflecting one or more of the legs forward, backward, or laterally to provide steering control.

Leg Motion and Hop

FIGS. 2A through 2D are diagrams that illustrate example forces that induce movement of the device 100 of FIG. 1. Some forces are provided by a rotational motor 202, which enable the device 100 to move autonomously across the surface 110. For example, the motor 202 can rotate an eccentric load 210 that generates moment and force vectors 205-215 as shown in FIGS. 2A-2D. Motion of the device 100 can also depend in part on the position of the legs 104 with respect to the counterweight 210 attached to the rotational motor 202. For example, placing the counterweight 210 in front of the front legs 104*a* will increase the tendency of the front legs 104*a* to provide the primary forward driving force (i.e., by focusing more of the up and down forces on the front legs). For example, the distance between the counterweight 210 and the tips of the driving legs can be within a range of 20-100% of an average length of the driving legs. Moving the counterweight 210 back relative to the front legs 104*a* can cause other legs to contribute more to the driving forces.

Figure 2B:
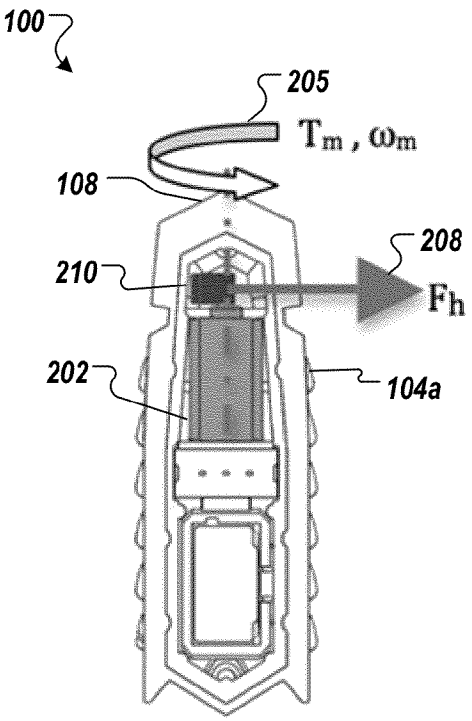
FIGS. 2A through 2D are diagrams that illustrate example forces that are involved with movement of the vibration powered device of FIG. 1.
Figure 2A:
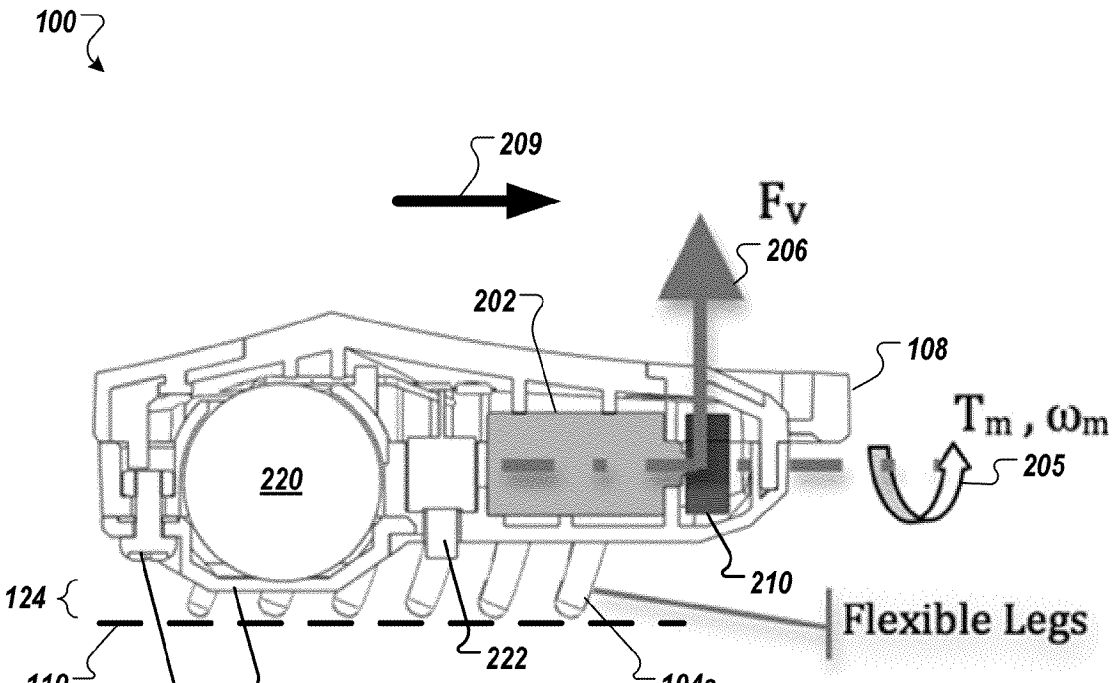

FIG. 2A shows a side view of the example device 100 shown in FIG. 1 and further depicts a rotational moment 205 (represented by the rotational velocity $\omega_m$ and motor torque $T_m$) and a vertical force 206 represented by $F_v$. FIG. 2B shows a top view of the example device 100 shown in FIG. 1 and further shows a horizontal force 208 represented by $F_h$. Generally, a negative $F_v$ is caused by upward movement of the eccentric load as it rotates, while a positive $F_v$ can be caused by the downward movement of the eccentric load and/or the resiliency of the legs (e.g., as they spring back from a deflected position).

The forces $F_v$ and $F_h$ cause the device 100 to move in a direction that is consistent with the configuration in which the leg base 106*b* is positioned in front of the leg tip 106*a*. The direction and speed in which the device 100 moves can depend, at least in part, on the direction and magnitude of $F_v$ and $F_h$. When the vertical force 206, $F_v$, is negative, the device 100 body is forced down. This negative $F_v$ causes at least the front legs 104*a* to bend and compress. The legs generally compress along a line in space from the leg tip to the leg base. As a result, the body will lean so that the leg bends (e.g., the leg base 106*b* flexes (or deflects) about the leg tip 106*a* towards the surface 110) and causes the body to move forward (e.g., in a direction from the leg tip 106*a* towards the leg base 106*b*). $F_v$, when positive, provides an upward force on the device 100 allowing the energy stored in the compressed legs to release (lifting the device), and at the same time allowing the legs to drag or hop forward to their original position. The lifting force $F_v$ on the device resulting from the rotation of the eccentric load combined with the spring-like leg forces are both involved in allowing the vehicle to hop vertically off the surface (or at least reducing the load on the front legs 104*a*) and allowing the legs 104 to return to their normal geometry (i.e., as a result of the resiliency of the legs). The release of the spring-like leg forces, along with the forward momentum created as the legs bend, propels the vehicle forward and upward, based on the angle of the line connecting the leg tip to the leg base, lifting the front legs 104*a* off the surface 110 (or at least reducing the load on the front legs 104*a*) and allowing the legs 104 to return to their normal geometry (i.e., as a result of the resiliency of the legs).

Generally, two "driving" legs (e.g., the front legs 104*a*, one on each side) are used, although some implementations may include only one driving leg or more than two driving legs. Which legs constitute driving legs can, in some implementations, be relative. For example, even when only one driving leg is used, other legs may provide a small amount of forward driving forces. During the forward motion, some legs 104 may tend to drag rather than hop. Hop refers to the result of the motion of the legs as they bend and compress and then return to their normal configuration—depending on the magnitude of $F_v$, the legs can either stay in contact with the surface or lift off the surface for a short period of time as the nose is elevated. For example, if the eccentric load is located toward the front of the device 100, then the front of the device 100 can hop slightly, while the rear of the device 100 tends to drag. In some cases, however, even with the eccentric load located toward the front of the device 100, even the back legs 104*c* may sometimes hop off the surface, albeit to a lesser extent than the front legs 104*a*. Depending on the stiffness or resiliency of the legs, the speed of rotation of the rotational motor, and the degree to which a particular hop is in phase or out of phase with the rotation of the motor, a hop can range in duration from less than the time required for a full rotation of the motor to the time required for multiple rotations of the motor. During a hop, rotation of the eccentric load can cause the device to move laterally in one direction or the other (or both at different times during the rotation) depending on the lateral direction of rotation at any particular time and to move up or down (or both at different times during the rotation) depending on the vertical direction of rotation at any particular time.

Increasing hop time can be a factor in increasing speed. The more time that the vehicle spends with some of the leg off the surface 110 (or lightly touching the surface), the less time some of the legs are dragging (i.e., creating a force opposite the direction of forward motion) as the vehicle translates forward. Minimizing the time that the legs drag forward (as opposed to hop forward) can reduce drag caused by friction of the legs sliding along the surface 110. In addition, adjusting the CG of the device fore and aft can effect whether the vehicle hops with the front legs only, or whether the vehicle hops with most, if not all, of the legs off the ground. This balancing of the hop can take into account the CG, the mass of the offset weight and its rotational frequency, $F_v$ and its location, and hop forces and their location(s).

Turning of Device

The motor rotation also causes a lateral force 208, $F_h$, which generally shifts back and forth as the eccentric load rotates. In general, as the eccentric load rotates (e.g., due to the motor 202), the left and right horizontal forces 208 are equal. The turning that results from the lateral force 208 on average typically tends to be greater in one direction (right or left) while the device's nose 108 is elevated, and greater in the opposite direction when the device's nose 108 and the legs 104 are compressed down. During the time that the center of the eccentric load 210 is traveling upward (away from the surface 110), increased downward forces are applied to the legs 104, causing the legs 104 to grip the surface 110, minimizing lateral turning of the device 100, although the legs may slightly bend laterally depending on the stiffness of the legs 104. During the time when the eccentric load 210 is traveling downward, the downward force on the legs 104 decreases, and downward force of the legs 104 on the surface 110 can be reduced, which can allow the device to turn laterally during the time the downward force is reduced. The direction of turning generally depends on the direction of the average lateral forces caused by the rotation of the eccentric load 210 during the time when the vertical forces are positive relative to when the vertical forces are negative. Thus, the horizontal force 208, $F_h$, can cause the device 100 to turn slightly more when the nose 108 is elevated. When the nose 108 is elevated, the leg tips are either off the surface 110 or less downward force is on the front legs 104*a* which precludes or reduces the ability of the leg tips (e.g., leg tip 106*a*) to "grip" the surface 110 and to provide lateral resistance to turning. Features can be implemented to manipulate several motion characteristics to either counteract or enhance this tendency to turn.

The location of the CG can also influence a tendency to turn. While some amount of turning by the device 100 can be a desired feature (e.g., to make the device's movement appear random), excessive turning can be undesirable. Several design considerations can be made to compensate for (or in some cases to take advantage of) the device's tendency to turn. For example, the weight distribution of the device 100, or more specifically, the device's CG, can affect the tendency of the device 100 to turn. In some implementations, having CG relatively near the center of the device 100 and roughly centered about the legs 104 can increase a tendency for the device 100 to travel in a relatively straight direction (e.g., not spinning around).

Tuning the drag forces for different legs 104 is another way to compensate for the device's tendency to turn. For example, the drag forces for a particular leg 104 can depend on the leg's length, thickness, stiffness and the type of material from which the leg is made. In some implementations, the stiffness of different legs 104 can be tuned differently, such as having different stiffness characteristics for the front legs 104*a*, rear legs 104*c* and middle legs 104*b*. For example, the stiffness characteristics of the legs can be altered or tuned based on the thickness of the leg or the material used for the leg. Increasing the drag (e.g., by increasing a leg length, thickness, stiffness, and/or frictional characteristic) on one side of the device (e.g., the right side) can help compensate for a tendency of the device to turn (e.g., to the left) based on the force $F_h$ induced by the rotational motor and eccentric load.

Altering the position of the rear legs 104*c* is another way to compensate for the device's tendency to turn. For example, placing the legs 104 further toward the rear of the device 100 can help the device 100 travel in a more straight direction. Generally, a longer device 100 that has a relatively longer distance between the front and rear legs 104*c* may tend to travel in more of a straight direction than a device 100 that is shorter in length (i.e., the front legs 104*a* and rear legs 104*c* are closer together), at least when the rotating eccentric load is located in a relatively forward position on the device 100. The relative position of the rearmost legs 104 (e.g., by placing the rearmost leg on one side of the device farther forward or backward on the device than the rearmost leg on the other side of the device) can also help compensate for (or alter) the tendency to turn.

Various techniques can also be used to control the direction of travel of the device 100, including altering the load on specific legs, adjusting the number of legs, leg lengths, leg positions, leg stiffness, and drag coefficients. As illustrated in FIG. 2B, the lateral horizontal force 208, $F_h$, causes the device 100 to have a tendency to turn as the lateral horizontal force 208 generally tends to be greater in one direction than the other during hops. The horizontal force 208, $F_h$ can be countered to make the device 100 move in an approximately straight direction. This result can be accomplished with adjustments to leg geometry and leg material selection, among other things.

Figure 2D:
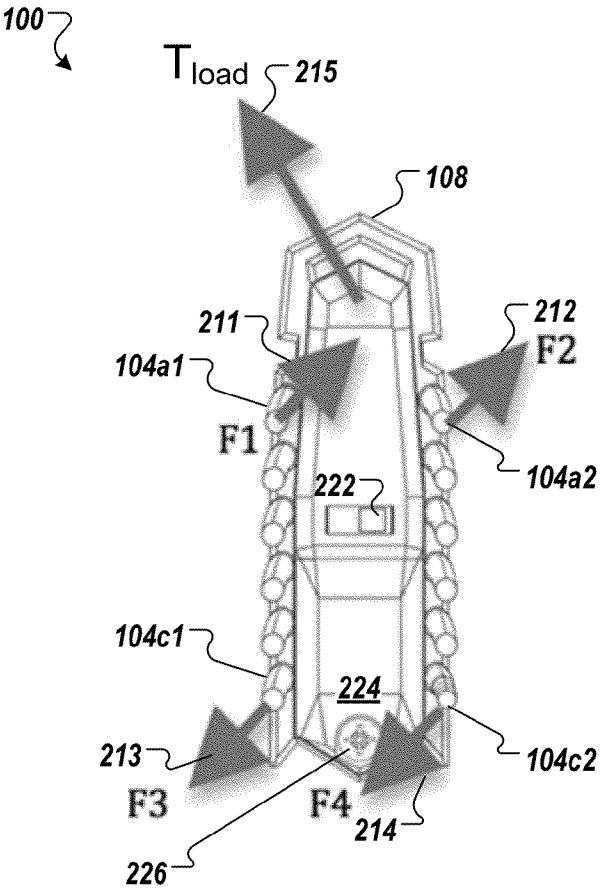
Figure 2C:
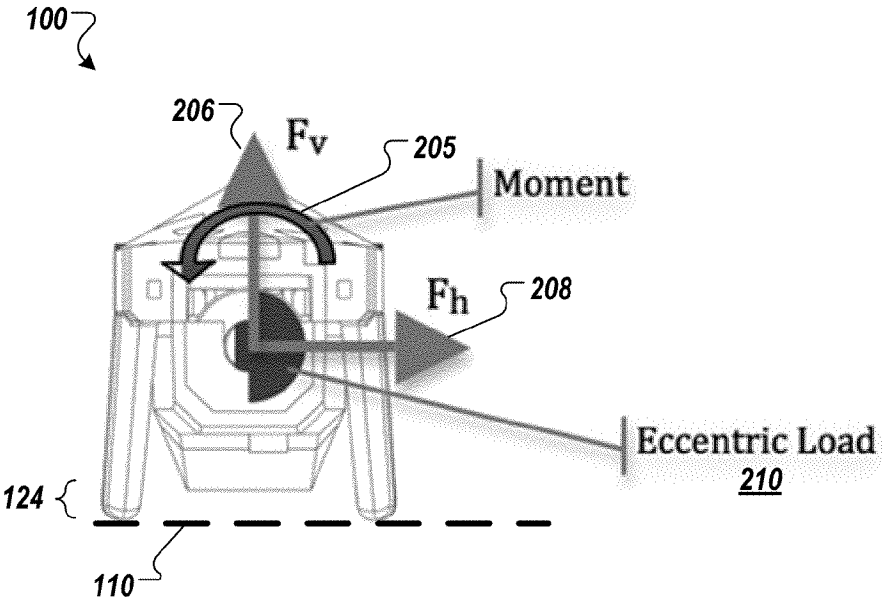

FIG. 2C is a diagram that shows a rear view of the device 100 and further illustrates the relationship of the vertical force 206 $F_v$ and the horizontal force 208 $F_h$ in relation to each other. This rear view also shows the eccentric load 210 that is rotated by the rotational motor 202 to generate vibration, as indicated by the rotational moment 205.

Drag Forces

FIG. 2D is a diagram that shows a bottom view of the device 100 and further illustrates example leg forces 211-214 that are involved with direction of travel of the device 100. In combination, the leg forces 211-214 can induce velocity vectors that impact the predominant direction of travel of the device 100. The velocity vector 215, represented by $T_{load}$, represents the velocity vector that is induced by the motor/eccentricity rotational velocity (e.g., induced by the offset load attached to the motor) as it forces the driving legs 104 to bend, causing the device to lunge forward, and as it generates greater lateral forces in one direction than the other during hopping. The leg forces 211-214, represented by $F_1$-$F_4$, represent the reactionary forces of the legs 104*a*1-104*c*2, respectively, that can be oriented so the legs 104*a*1-104*c*2, in combination, induce an opposite velocity vector relative to $T_{load}$. As depicted in FIG. 2D, $T_{load}$ is a velocity vector that tends to steer the device 100 to the left (as shown) due to the tendency for there to be greater lateral forces in one direction than the other when the device is hopping off the surface 110. At the same time, the forces $F_1$-$F_2$ for the front legs 104*a*1 and 104*a*2 (e.g., as a result of the legs tending to drive the device forward and slightly laterally in the direction of the eccentric load 210 when the driving legs are compressed) and the forces $F_3$-$F_4$ for the rear legs 104*c*1 and 104*c*2 (as a result of drag) each contribute to steering the device 100 to the right (as shown). (As a matter of clarification, because FIG. 2D shows the bottom view of the device 100, the left-right directions when the device 100 is placed upright are reversed.) In general, if the combined forces $F_1$-$F_4$ approximately offset the side component of $T_{load}$, then the device 100 will tend to travel in a relatively straight direction.

Controlling the forces $F_1$-$F_4$ can be accomplished in a number of ways. For example, the "push vector" created by the front legs 104*a*1 and 104*a*2 can be used to counter the lateral component of the motor-induced velocity. In some implementations, this can be accomplished by placing more weight on the front leg 104*a*2 to increase the leg force 212, represented by $F_2$, as shown in FIG. 2D. Furthermore, a "drag vector" can also be used to counter the motor-induced velocity. In some implementations, this can be accomplished by increasing the length of the rear leg 104*c*2 or increasing the drag coefficient on the rear leg 104*c*2 for the force vector 804, represented by $F_4$, in FIG. 2D. As shown, the legs 104*a*1 and 104*a*2 are the device's front right and left legs, respectively, and the legs 104*c*1 and 104*c*2 are the device's rear right and left legs, respectively.

Another technique for compensating for the device's tendency to turn is increasing the stiffness of the legs 104 in various combinations (e.g., by making one leg thicker than another or constructing one leg using a material having a naturally greater stiffness). For example, a stiffer leg will have a tendency to bounce more than a more flexible leg. Left and right legs 104 in any leg pair can have different stiffnesses to compensate for the turning of the device 100 induced by the vibration of the motor 202. Stiffer front legs 104*a* can also produce more bounce.

Another technique for compensating for the device's tendency to turn is to change the relative position of the rear legs 104*c*1 and 104*c*2 so that the drag vectors tend to compensate for turning induced by the motor velocity. For example, the rear leg 104*c*2 can be placed farther forward (e.g., closer to the nose 108) than the rear leg 104*c*1.

Leg Shape

Leg geometry contributes significantly to the way in which the device 100 moves. Aspects of leg geometry include: locating the leg base in front of the leg tip, curvature of the legs, deflection properties of the legs, configurations that result in different drag forces for different legs, including legs that do not necessarily touch the surface, and having only three legs that touch the surface, to name a few examples.

Generally, depending on the position of the leg tip 106*a* relative to the leg base 106*b*, the device 100 can experience different behaviors, including the speed and stability of the device 100. For example, if the leg tip 106*a* is nearly directly below the leg base 106*b* when the device 100 is positioned on a surface, movement of the device 100 that is caused by the motor 202 can be limited or precluded. This is because there is little or no slope to the line in space that connects the leg tip 106*a* and the leg base 106*b*. In other words, there is no "lean" in the leg 104 between the leg tip 106*a* and the leg base 106*b*. However, if the leg tip 106*a* is positioned behind the leg base 106*b* (e.g., farther from the nose 108), then the device 100 can move faster, as the slope or lean of the legs 104 is increased, providing the motor 202 with a leg geometry that is more conducive to movement. In some implementations, different legs 104 (e.g., including different pairs, or left legs versus right legs) can have different distances between leg tips 106*a* and leg bases 106*b*.

In some implementations, the legs 104 are curved (e.g., leg 104*a* shown in FIG. 2A, and legs 104 shown in FIG. 1). For example, because the legs 104 are typically made from a flexible material, the curvature of the legs 104 can contribute to the forward motion of the device 100. Curving the leg can accentuate the forward motion of the device 100 by increasing the amount that the leg compresses relative to a straight leg. This increased compression can also increase vehicle hopping, which can also increase the tendency for random motion, giving the device an appearance of intelligence and/or a more life-like operation. The legs can also have at least some degree of taper from the leg base 106*b* to the leg tip 106*a*, which can facilitate easier removal from a mold during the manufacturing process.

The number of legs can vary in different implementations. In general, increasing the number of legs 104 can have the effect of making the device more stable and can help reduce fatigue on the legs that are in contact with the surface 110. Increasing the number of legs can also affect the location of drag on the device 100 if additional leg tips 106*a* are in contact with the surface 110. In some implementations, however, some of the legs (e.g., middle legs 104*b*) can be at least slightly shorter than others so that they tend not to touch the surface 110 or contribute less to overall friction that results from the leg tips 106*a* touching the surface 110. For example, in some implementations, the two front legs 104*a* (e.g., the "driving" legs) and at least one of the rear legs 104*c* are at least slightly longer than the other legs. This configuration helps increase speed by increasing the forward driving force of the driving legs. In general, the remaining legs 104 can help prevent the device 100 from tipping over by providing additional resiliency should the device 100 start to lean toward one side or the other.

In some implementations, one or more of the "legs" can include any portion of the device that touches the ground. For example, the device 100 can include a single rear leg (or multiple rear legs) constructed from a relatively inflexible material (e.g., rigid plastic), which can resemble the front legs or can form a skid plate designed to simply drag as the front legs 104*a* provide a forward driving force. The oscillating eccentric load can repeat tens to several hundred times per second, which causes the device 100 to move in a generally forward motion as a result of the forward momentum generated when $F_v$ is negative.

Leg geometry can be defined and implemented based on ratios of various leg measurements, including leg length, diameter, and radius of curvature. One ratio that can be used is the ratio of the radius of curvature of the leg 104 to the leg's length. As just one example, if the leg's radius of curvature is 49.14 mm and the leg's length is 10.276 mm, then the ratio is 4.78. In another example, if the leg's radius of curvature is 2.0 inches and the leg's length is 0.4 inches, then the ratio is 5.0. Other leg 104 lengths and radii of curvature can be used, such as to produce a ratio of the radius of curvature to the leg's length that leads to suitable movement of the device 100. In general, the ratio of the radius of curvature to the leg's length can be in the range of 2.5 to 20.0. The radius of curvature can be approximately consistent from the leg base to the leg tip. This approximate consistent curvature can include some variation, however. For example, some taper angle in the legs may be required during manufacturing of the device (e.g., to allow removal from a mold). Such a taper angle may introduce slight variations in the overall curvature that generally do not prevent the radius of curvature from being approximately consistent from the leg base to the leg tip.

Another ratio that can be used to characterize the device 100 is a ratio that relates leg 104 length to leg diameter or thickness (e.g., as measured in the center of the leg or as measured based on an average leg diameter throughout the length of the leg and/or about the circumference of the leg). For example, the length of the legs 104 can be in the range of 0.2 inches to 0.8 inches (e.g., 0.405 inches) and can be proportional to (e.g., 5.25 times) the leg's thickness in the range of 0.03 to 0.15 inch (e.g., 0.077 inch). Stated another way, legs 104 can be about 15% to 25% as thick as they are long, although greater or lesser thicknesses (e.g., in the range of 5% to 60% of leg length) can be used. Leg 104 lengths and thicknesses can further depend on the overall size of the device 100. In general, at least one driving leg can have a ratio of the leg length to the leg diameter in the range of 2.0 to 20.0 (i.e., in the range of 5% to 50% of leg length). In some implementations, a diameter of at least 10% of the leg length may be desirable to provide sufficient stiffness to support the weight of the device and/or to provide desired movement characteristics.

Leg Material

The legs are generally constructed of rubber or other flexible but resilient material (e.g., polystyrene-butadiene-styrene with a durometer near 65, based on the Shore A scale, or in the range of 55-75, based on the Shore A scale). Thus, the legs tend to deflect when a force is applied. Generally, the legs include a sufficient stiffness and resiliency to facilitate consistent forward movement as the device vibrates (e.g., as the eccentric load 210 rotates). The legs 104 are also sufficiently stiff to maintain a relatively wide stance when the device 100 is upright yet allow sufficient lateral deflection when the device 100 is on its side to facilitate self-righting, as further discussed below.

The selection of leg materials can have an effect on how the device 100 moves. For example, the type of material used and its degree of resiliency can affect the amount of bounce in the legs 104 that is caused by the vibration of the motor 202 and the counterweight 210. As a result, depending on the material's stiffness (among other factors, including positions of leg tips 106*b* relative to leg bases 106*a*), the speed of the device 100 can change. In general, the use of stiffer materials in the legs 104 can result in more bounce, while more flexible materials can absorb some of the energy caused by the vibration of the motor 202, which can tend to decrease the speed of the device 100.

Frictional Characteristics

Friction (or drag) force equals the coefficient of friction multiplied by normal force. Different coefficients of friction and the resulting friction forces can be used for different legs. As an example, to control the speed and direction (e.g., tendency to turn, etc.), the leg tips 106*a* can have varying coefficients of friction (e.g., by using different materials) or drag forces (e.g., by varying the coefficients of friction and/or the average normal force for a particular leg). These differences can be accomplished, for example, by the shape (e.g., pointedness or flatness, etc.) of the leg tips 106*a* as well as the material of which they are made. Front legs 104*a*, for example, can have a higher friction than the rear legs 104*c*. Middle legs 104*b* can have yet different friction or can be configured such that they are shorter and do not touch the surface 110, and thus do not tend to contribute to overall drag. Generally, because the rear legs 104*c* (and the middle legs 104*b* to the extent they touch the ground) tend to drag more than they tend to create a forward driving force, lower coefficients of friction and lower drag forces for these legs can help increase the speed of the device 100. Moreover, to offset the motor force 215, which can tend to pull the device in a left or right direction, left and right legs 104 can have different friction forces. Overall, coefficients of friction and the resulting friction force of all of the legs 104 can influence the overall speed of the device 100. The number of legs 104 in the device 100 can also be used to determine coefficients of friction to have in (or design into) each of the individual legs 104. As discussed above, the middle legs 104*b* do not necessarily need to touch the surface 110. For example, middle (or front or back) legs 104 can be built into the device 100 for aesthetic reasons, e.g., to make the device 100 appear more life-like, and/or to increase device stability. In some implementations, devices 100 can be made in which only three (or a small number of) legs 104 touch the ground, such as two front legs 104*a* and one or two rear legs 104*c*.

The motor 202 is coupled to and rotates a counterweight 210, or eccentric load, that has a CG that is off axis relative to the rotational axis of the motor 202. The rotational motor 202 and counterweight 210, in addition to being adapted to propel the device 100, can also cause the device 100 to tend to roll, e.g., about the axis of rotation of the rotational motor 200. The rotational axis of the motor 202 can have an axis that is approximately aligned with a longitudinal CG of the device 100, which is also generally aligned with a direction of movement of the device 100.

FIG. 2A also shows a battery 220 and a switch 222. The battery 220 can provide power to the motor 202, for example, when the switch 222 is in the "ON" position, thus connecting an electrical circuit that delivers electric current to the motor 202. In the "OFF" position of the switch 222, the circuit is broken, and no power reaches the motor 202. The battery 220 can be located within or above a battery compartment cover 224, accessible, for example, by removing a screw 226, as shown in FIGS. 2A and 2D. The placement of the battery 220 and the switch 222 partially between the legs of the device 100 can lower the device's CG and help to prevent tipping. Locating the motor 202 lower within the device 100 also reduces tipping. Having legs 104 on the sides of a vehicle 100 provides a space (e.g., between the legs 104) to house the battery 220, the motor 204 and the switch 222. Positioning these components 204, 220 and 222 along the underside of the device 100 (e.g., rather than on top of the device housing) effectively lowers the CG of the device 100 and reduces its likelihood of tipping.

The device 100 can be configured such that the CG is selectively positioned to influence the behavior of the device 100. For example, a lower CG can help to prevent tipping of the device 100 during its operation. As an example, tipping can occur as a result of the device 100 moving at a high rate of speed and crashing into an obstacle. In another example, tipping can occur if the device 100 encounters a sufficiently irregular area of the surface on which it is operating. The CG of the device 100 can be selectively manipulated by positioning the motor, switch, and battery in locations that provide a desired CG, e.g., one that reduces the likelihood of inadvertent tipping. In some implementations, the legs can be configured so that they extend from the leg tip 106*a* below the CG to a leg base 106*b* that is above the CG, allowing the device 100 to be more stable during its operation. The components of the device 100 (e.g., motor, switch, battery, and housing) can be located at least partially between the legs to maintain a lower CG. In some implementations, the components of the device (e.g., motor, switch and battery) can be arranged or aligned close to the CG to maximize forces caused by the motor 202 and the counterweight 210.

Self-Righting

Self-righting, or the ability to return to an upright position (e.g., standing on legs 104), is another feature of the device 100. For example, the device 100 can occasionally tip over or fall (e.g., falling off a table or a step). As a result, the device 100 can end up on its top or its side. In some implementations, self-righting can be accomplished using the forces caused by the motor 202 and the counterweight 210 to cause the device 100 to roll over back onto its legs 104. Achieving this result can be helped by locating the device's CG proximal to the motor's rotational axis to increase the tendency for the entire device 100 to roll. This self-righting generally provides for rolling in the direction that is opposite to the rotation of the motor 202 and the counterweight 210.

Provided that a sufficient level of roll tendency is produced based on the rotational forces resulting from the rotation of the motor 202 and the counterweight 210, the outer shape of the device 100 can be designed such that rolling tends to occur only when the device 100 is on its right side, top side, or left side. For example, the lateral spacing between the legs 104 can be made wide enough to discourage rolling when the device 100 is already in the upright position. Thus, the shape and position of the legs 104 can be designed such that, when self-righting occurs and the device 100 again reaches its upright position after tipping or falling, the device 100 tends to remain upright. In particular, by maintaining a flat and relatively wide stance in the upright position, upright stability can be increased, and, by introducing features that reduce flatness when not in an upright position, the self-righting capability can be increased.

To assist rolling from the top of the device 100, a high point 120 or a protrusion can be included on the top of the device 100. The high point 120 can prevent the device from resting flat on its top. In addition, the high point 120 can prevent $F_h$ from becoming parallel to the force of gravity, and as a result, $F_h$ can provide enough moment to cause the device to roll, enabling the device 100 to roll to an upright position or at least to the side of the device 100. In some implementations, the high point 120 can be relatively stiff (e.g., a relatively hard plastic), while the top surface of the head 118 can be constructed of a more resilient material that encourages bouncing. Bouncing of the head 118 of the device when the device is on its back can facilitate self-righting by allowing the device 100 to roll due to the forces caused by the motor 202 and the counterweight 210 as the head 118 bounces off the surface 110.

Rolling from the side of the device 100 to an upright position can be facilitated by using legs 104 that are sufficiently flexible in combination with the space 124 (e.g., underneath the device 100) for lateral leg deflection to allow the device 100 to roll to an upright position. This space can allow the legs 104 to bend during the roll, facilitating a smooth transition from side to bottom. The shoulders 112 on the device 100 can also decrease the tendency for the device 100 to roll from its side onto its back, at least when the forces caused by the motor 202 and the counterweight 210 are in a direction that opposes rolling from the side to the back. At the same time, the shoulder on the other side of the device 100 (even with the same configuration) can be designed to avoid preventing the device 100 from rolling onto its back when the forces caused by the motor 202 and the counterweight 210 are in a direction that encourages rolling in that direction. Furthermore, use of a resilient material for the shoulder can increase bounce, which can also increase the tendency for self-righting (e.g., by allowing the device 100 to bounce off the surface 110 and allowing the counterweight forces to roll the device while airborne). Self-righting from the side can further be facilitated by adding appendages along the side(s) of the device 100 that further separate the rotational axis from the surface and increase the forces caused by the motor 202 and the counterweight 210.

The position of the battery on the device 100 can affect the device's ability to roll and right itself. For example, the battery can be oriented on its side, positioned in a plane that is both parallel to the device's direction of movement and perpendicular to the surface 110 when the device 100 is upright. This positioning of the battery in this manner can facilitate reducing the overall width of the device 100, including the lateral distance between the legs 104, making the device 100 more likely to be able to roll.

FIG. 4 shows an example front view indicating a center of gravity (CG) 402, as indicated by a large plus sign, for the device 100. This view illustrates a longitudinal CG 402 (i.e., a location of a longitudinal axis of the device 100 that runs through the device CG). In some implementations, the vehicle's components are aligned to place the longitudinal CG close to (e.g., within 5-10% as a percentage of the height of the vehicle) the physical longitudinal centerline of the vehicle, which can reduce the rotational moment of inertia of the vehicle, thereby increasing or maximizing the forces on the vehicle as the rotational motor rotates the eccentric load. As discussed above, this effect increases the tendency of the device 100 to roll, which can enhance the self-righting capability of the device. FIG. 4 also shows a space 404 between the legs 104 and the underside 122 of the vehicle 100 (including the battery compartment cover 224), which can allow the legs 104 to bend inward when the device is on its side, thereby facilitating self-righting of the device 100. FIG. 4 also illustrates a distance 406 between the pairs or rows of legs 104. Increasing the distance 406 can help prevent the vehicle 100 from tipping. However, keeping the distance 406 sufficiently low, combined with flexibility of the legs 104, can improve the vehicle's ability to self-right after tipping. In general, to prevent tipping, the distance 406 between pairs of legs needs to be increased proportionally as the CG 402 is raised.

The vehicle high point 120 is also shown in FIG. 4. The size or height of the high point 120 can be sufficiently large enough to prevent the device 100 from simply lying flat on its back after tipping, yet sufficiently small enough to help facilitate the device's roll and to force the device 100 off its back after tipping. A larger or higher high point 120 can be better tolerated if combined with "pectoral fins" or other side protrusions to increase the "roundness" of the device.

The tendency to roll of the device 100 can depend on the general shape of the device 100. For example, a device 100 that is generally cylindrical, particularly along the top of the device 100, can roll relatively easily. Even if the top of the device is not round, as is the case for the device shown in FIG. 4 that includes straight top sides 407*a* and 407*b*, the geometry of the top of the device 100 can still facilitate rolling. This is especially true if distances 408 and 410 are relatively equal and each approximately defines the radius of the generally cylindrical shape of the device 100. Distance 408, for example, is the distance from the device's longitudinal CG 402 to the top of the shoulder 112. Distance 410 is the distance from the device's longitudinal CG 402 to the high point 120. Further, having a length of surface 407*b* (i.e., between the top of the shoulder 112 and the high point 120) that is less than the distances 408 and 410 can also increase the tendency of the device 100 to roll. Moreover, if the device's longitudinal CG 402 is positioned relatively close to the center of the cylinder that approximates the general shape of the device 100, then roll of the device 100 is further enhanced, as the forces caused by the motor 202 and the counterweight 210 are generally more centered. The device 100 can stop rolling once the rolling action places the device 100 on its legs 104, which provide a wide stance and serve to interrupt the generally cylindrical shape of the device 100.

Figure 5:
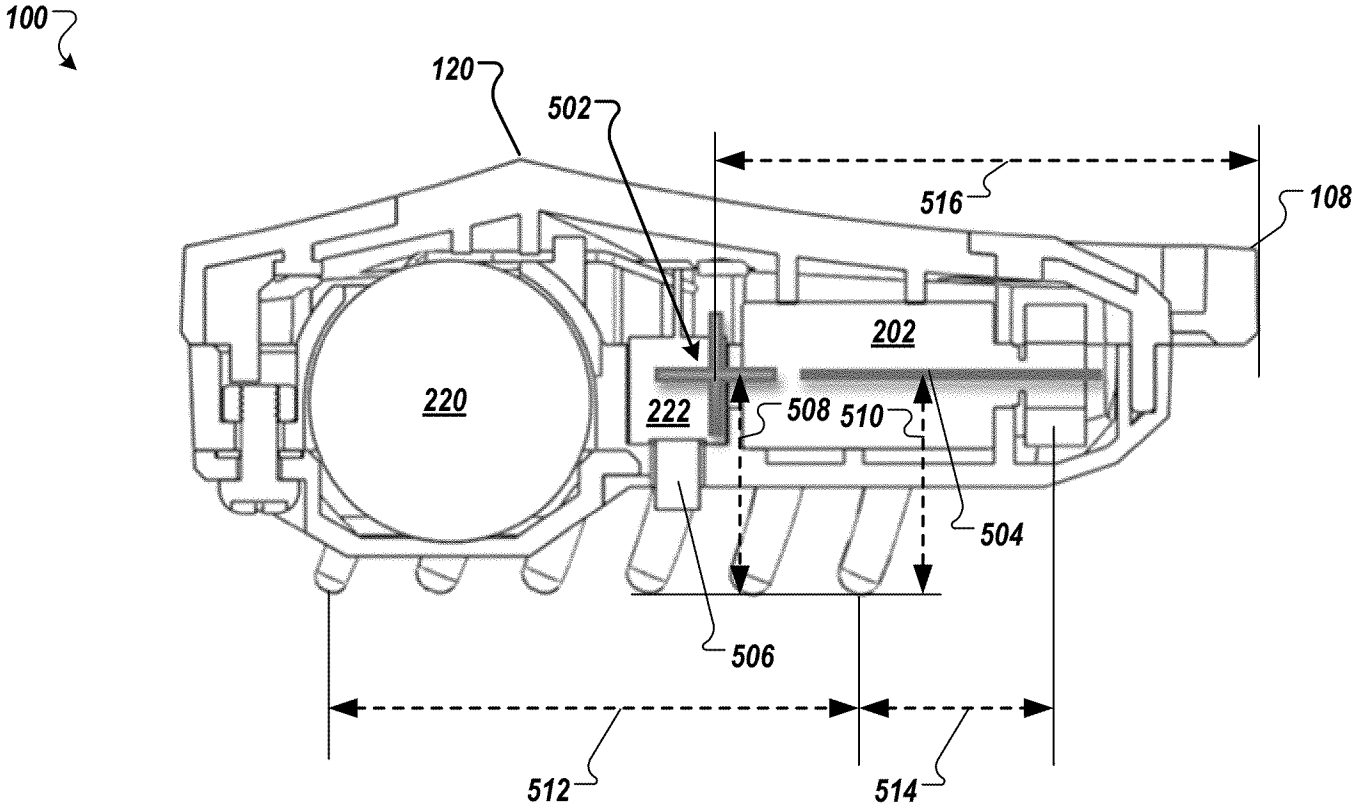
FIG. 5 shows an example side view indicating a center of gravity for the device.

FIG. 5 shows an example side view indicating a center of gravity (CG) 502, as indicated by a large plus sign, for the device 100. This view also shows a motor axis 504 which, in this example, closely aligns with the longitudinal component of the CG 502. The location of the CG 502 depends on, e.g., the mass, thickness, and distribution of the materials and components included in the device 100. In some implementations, the CG 502 can be farther forward or farther back from the location shown in FIG. 5. For example, the CG 502 can be located toward the rear end of the switch 222 rather than toward the front end of the switch 222 as illustrated in FIG. 5. In general, the CG 502 of the device 100 can be sufficiently far behind the front driving legs 104*a* and the rotating eccentric load (and sufficiently far in front of the rear legs 104*c*) to facilitate front hopping and rear drag, which can increase forward drive and provide a controlled tendency to go straight (or turn if desired) during hops. For example, the CG 502 can be positioned roughly halfway (e.g., in the range of roughly 40-60% of the distance) between the front driving legs 104*a* and the rear dragging legs 104*c*. Also, aligning the motor axis with the longitudinal CG can enhance forces caused by the motor 202 and the counterweight. In some implementations, the longitudinal component of the CG 502 can be near to the center of the height of the device (e.g., within about 3% of the CG as a proportion of the height of the device). Generally, configuring the device 100 such that the CG 502 is closer to the center of the height of the device will enhance the rolling tendency, although greater distances (e.g., within about 5% or within about 20% of the CG as a proportion of the height of the device) are acceptable in some implementations. Similarly, configuring the device 100 such that the CG 502 is within about 3-6% of the motor axis 504 as a percentage of the height of the device can also enhance the rolling tendency.

FIG. 5 also shows an approximate alignment of the battery 220, the switch 222 and the motor 202 with the longitudinal component of the CG 502. Although a sliding switch mechanism 506 that operates the on/off switch 222 hangs below the underside of the device 100, the overall approximate alignment of the CG of the individual components 220, 222 and 202 (with each other and with the CG 502 of the overall device 100) contributes to the ability of the device 100 to roll, and thus right itself. In particular, the motor 202 is centered primarily along the longitudinal component of the CG 502.

In some implementations, the high point 120 can be located behind the CG 502, which can facilitate self-righting in combination with the eccentric load attached to the motor 202 being positioned near the nose 108. As a result, if the device 100 is on its side or back, the nose end of the device 100 tends to vibrate and bounce (more so than the tail end of the device 100), which facilitates self-righting as the forces of the motor and eccentric load tend to cause the device to roll.

FIG. 5 also shows some of the sample dimensions of the device 100. For example, a distance 508 between the CG 502 and a plane that passes through the leg tips 106*a* on which the device 100 rests when upright on a flat surface 110 can be approximately 0.36 inches. In some implementations, this distance 508 is approximately 50% of the total height of the device (see FIGS. 7A & 7B), although other distances 508 may be used in various implementations (e.g., from about 40-60%). A distance 510 between the rotational axis 504 of the motor 202 and the same plane that passes through the leg tips 106*a* is approximately the same as the distance 508, although variations (e.g., 0.34 inches for distance 510 vs. 0.36 inches for distance 508) may be used without materially impacting desired functionality. Greater variations (e.g., 0.05 inches or even 0.1 inches) may be used in some implementations.

A distance 512 between the leg tip 106*a* of the front driving legs 104*a* and the leg tip 106*a* of the rearmost leg 104*c* can be approximately 0.85 inches, although various implementations can include other values of the distance 512 (e.g., between about 40% and about 75% of the length of the device 100). In some implementations, locating the front driving legs 104*a* behind the eccentric load 210 can facilitate forward driving motion and randomness of motion. For example, a distance 514 between a longitudinal centerline of the eccentric load 210 and the tip 106*a* of the front leg 104*a* can be approximately 0.36 inches. Again, other distances 514 can be used (e.g., between about 5% and about 30% of the length of the device 100 or between about 10% and about 60% of the distance 512). A distance 516 between the front of the device 100 and the CG 502 can be about 0.95 inches. In various implementations, the distance 516 may range from about 40-60% of the length of the device 100, although some implementations may include front or rear protrusions with a low mass that add to the length of the device but do not significantly impact the location of the CG 502 (i.e., therefore causing the CG 502 to be outside of the 40-60% range).

Figure 9A:
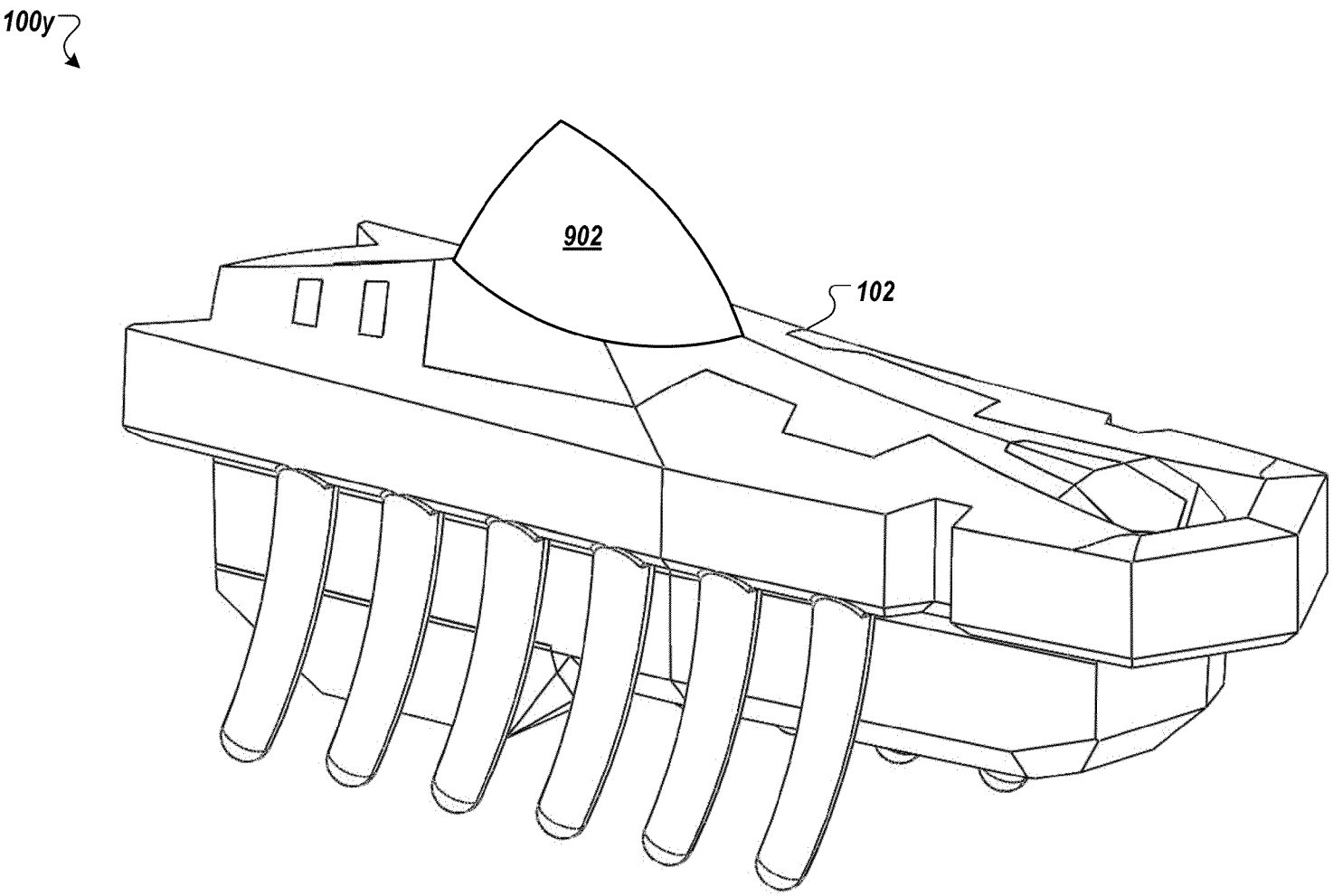
FIGS. 9A and 9B show example devices that include a shark/dorsal fin and a pair of side/pectoral fins, respectively.
Figure 9B:
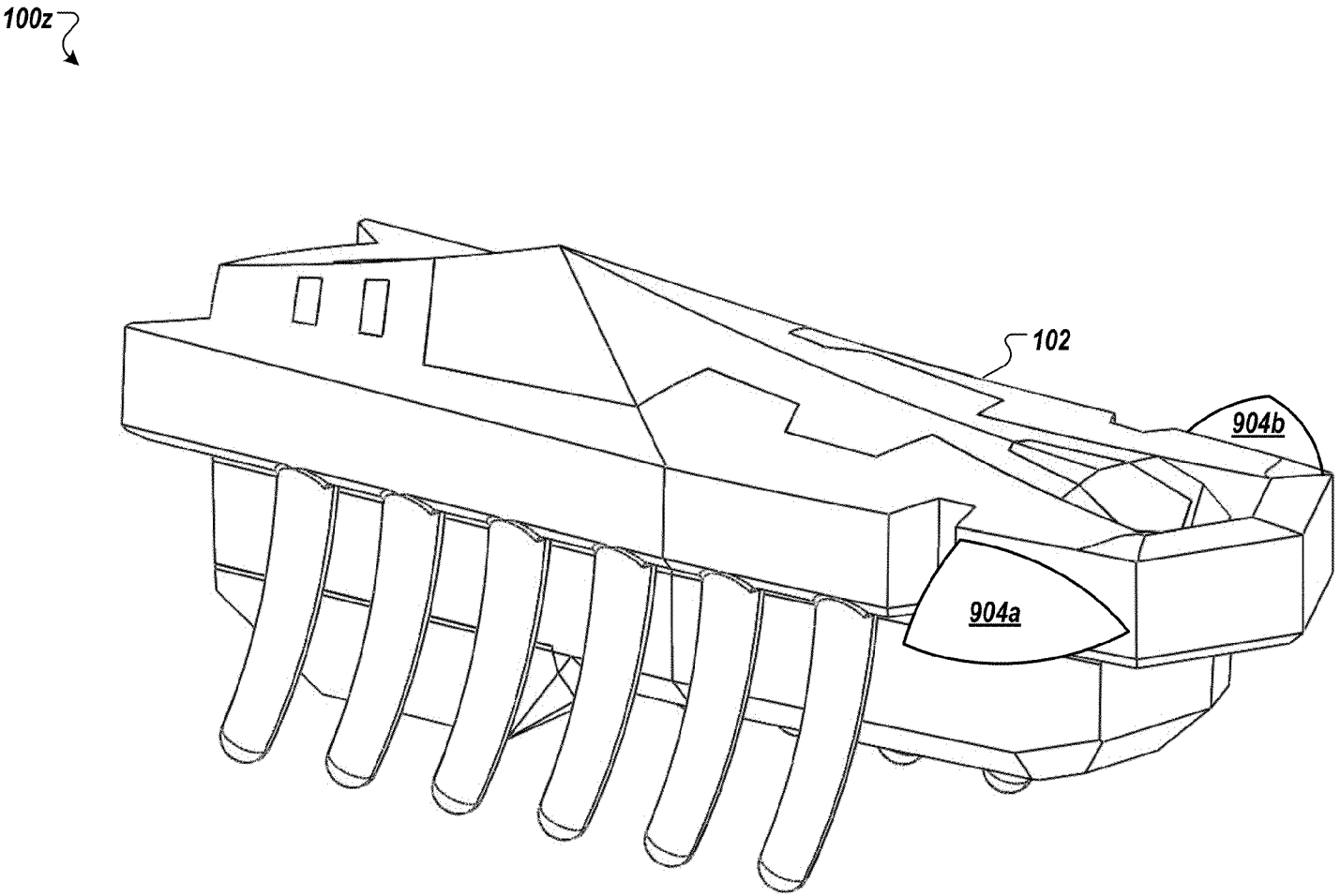

FIGS. 9A and 9B show example devices 100*y* and 100*z* that include, respectively, a shark/dorsal fin 902 and side/pectoral fins 904*a* and 904*b*. As shown in FIG. 9A, the shark/dorsal fin 902 can extend upward from the body 102 so that, if the device 100*y* tips, then the device 100*y* will not end up on its back and can right itself. The side/pectoral fins 904*a* and 904*b* shown in FIG. 9B extend partially outward from the body 102. As a result, if the device 100*z* begins to tip to the device's left or right, then the fin on that side (e.g., fin 904*a* or fin 904*b*) can stop and reverse the tipping action, returning the device 100*z* to its upright position. In addition, the fins 904*a* and 904*b* can facilitate self-righting by increasing the distance between the CG and the surface when the device is on its side. This effect can be enhanced when the fins 904*a* and 904*b* are combined with a dorsal fin 902 on a single device. In this way, fins 902, 904*a* and 904*b* can enhance the self-righting of the devices 100*y* and 100*z*. Constructing the fins 902, 904*a* and

904*b* from a resilient material that increases bounce when the fins are in contact with a surface can also facilitate self-righting (e.g., to help overcome the wider separation between the tips of the fins 902, 904*a* and 904*b*). Fins 902, 904*a* and 904*b* can be constructed of light-weight rubber or plastic so as not to significantly change the device's CG.

Random Motion

By introducing features that increase randomness of motion of the device 100, the device 100 can appear to behave in an animate way, such as like a crawling bug or other organic life-form. The random motion can include inconsistent movements, for example, rather than movements that tend to be in straight lines or continuous circles. As a result, the device 100 can appear to roam about its surroundings (e.g. in an erratic or serpentine pattern) instead of moving in predictable patterns. Random motion can occur, for example, even while the device 100 is moving in one general direction.

In some implementations, randomness can be achieved by changing the stiffness of the legs 104, the material used to make the legs 104, and/or by adjusting the inertial load on various legs 104. For example, as leg stiffness is reduced, the amount of device hopping can be reduced, thus reducing the appearance of random motion. When the legs 104 are relatively stiff, the legs 104 tend to induce hopping, and the device 100 can move in a more inconsistent and random motion.

While the material that is selected for the legs 104 can influence leg stiffness, it can also have other effects. For example, the leg material can be manipulated to attract dust and debris at or near the leg tips 106*a*, where the legs 104 contact the surface 110. This dust and debris can cause the device 100 to turn randomly and change its pattern of motion. This can occur because the dust and debris can alter the typical frictional characteristics of the legs 104.

The inertial load on each leg 104 can also influence randomness of motion of the device 100. As an example, as the inertial load on a particular leg 104 is increased, that portion of the device 100 can hop at higher amplitude, causing the device 100 to land in different locations.

In some implementations, during a hop and while at least some legs 104 of the device 100 are airborne (or at least applying less force to the surface 110), the motor 202 and the counterweight 210 can cause some level of mid-air turning and/or rotating of the device 100. This can provide the effect of the device landing or bouncing in unpredictable ways, which can further lead to random movement.

In some implementations, additional random movement can result from locating front driving legs 104*a* (i.e., the legs that primarily propel the device 100 forward) behind the motor's counterweight. This can cause the front of the device 100 to tend to move in a less straight direction because the counterweight is farther from legs 104 that would otherwise tend to absorb and control its energy. An example lateral distance from the center of the counterweight to the tip of the first leg of 0.36 inches compared to an example leg length of 0.40 inches. Generally, the distance 514 from the longitudinal centerline of the counterweight to the tip 106*a* of the front leg 104*a* may be approximately the same as the length of the leg but the distance 514 can vary in the range of 50-150% of the leg length.

In some implementations, additional appendages can be added to the legs 104 (and to the housing 102) to provide resonance. For example, flexible protrusions that are constantly in motion in this way can contribute to the overall randomness of motion of the device 100 and/or to the lifelike appearance of the device 100. Using appendages of different sizes and flexibilities can magnify the effect.

In some implementations, the battery 220 can be positioned near the rear of the device 100 to increase hop. Doing so positions the weight of the battery 220 over the rearmost legs 104, reducing load on the front legs 104*a*, which can allow for more hop at the front legs 104*a*. In general, the battery 220 can tend to be heavier than the switch 222 and motor 202, thus placement of the battery 220 nearer the rear of the device 100 can elevate the nose 108, allowing the device 100 to move faster.

In some implementations, the on/off switch 222 can be oriented along the bottom side of the device 100 between the battery 220 and the motor 204 such that the switch 222 can be moved back and forth laterally. Such a configuration, for example, helps to facilitate reducing the overall length of the device 100. Having a shorter device can enhance the tendency for random motion.

Speed of Movement

In addition to random motion, the speed of the device 100 can contribute to the life-like appearance of the device 100. Factors that affect speed include the vibration frequency and amplitude that are produced by the motor 202 and counterweight 210, the materials used to make the legs 104, leg length and deflection properties, differences in leg geometry, and the number of legs.

Vibration frequency (e.g., based on motor rotation speed) and device speed are generally directly proportional. That is, when the oscillating frequency of the motor 202 is increased and all other factors are held constant, the device 100 will tend to move faster. An example oscillating frequency of the motor is in the range of 7000 to 9000 rpm.

Leg material has several properties that contribute to speed. Leg material friction properties influence the magnitude of drag force on the device. As the coefficient of friction of the legs increases, the device's overall drag will increase, causing the device 100 to slow down. As such, the use of leg material having properties promoting low friction can increase the speed of the device 100. In some implementations, polystyrene-butadiene-styrene with a durometer near 65 (e.g., based on the Shore A scale) can be used for the legs 104. Leg material properties also contribute to leg stiffness which, when combined with leg thickness and leg length, determines how much hop a device 100 will develop. As the overall leg stiffness increases, the device speed will increase. Longer and thinner legs will reduce leg stiffness, thus slowing the device's speed.

Appearance of Intelligence

"Intelligent" response to obstacles is another feature of the device 100. For example, "intelligence" can prevent a device 100 that comes in contact with an immoveable object (e.g., a wall) from futilely pushing against the object. The "intelligence" can be implemented using mechanical design considerations alone, which can obviate the need to add electronic sensors, for example. For example, turns (e.g., left or right) can be induced using a nose 108 that introduces a deflection or bounce in which a device 100 that encounters an obstacle immediately turns to a near incident angle.

In some implementations, adding a "bounce" to the device 100 can be accomplished through design considerations of the nose and the legs 104, and the speed of the device 100. For example, the nose 108 can include a spring-like feature. In some implementations, the nose 108 can be manufactured using rubber, plastic, or other materials (e.g., polystyrene-butadiene-styrene with a durometer near 65, or in the range of 55-75, based on the Shore A scale). The nose 108 can have a pointed, flexible shape that deflects inward under pressure. Design and configuration of the legs 104 can allow for a low resistance to turning during a nose bounce. Bounce achieved by the nose can be increased, for example, when the device 100 has a higher speed and momentum.

In some implementations, the resiliency of the nose 108 can be such that it has an added benefit of dampening a fall should the device 100 fall off a surface 110 (e.g., a table) and land on its nose 108.

Figure 6:
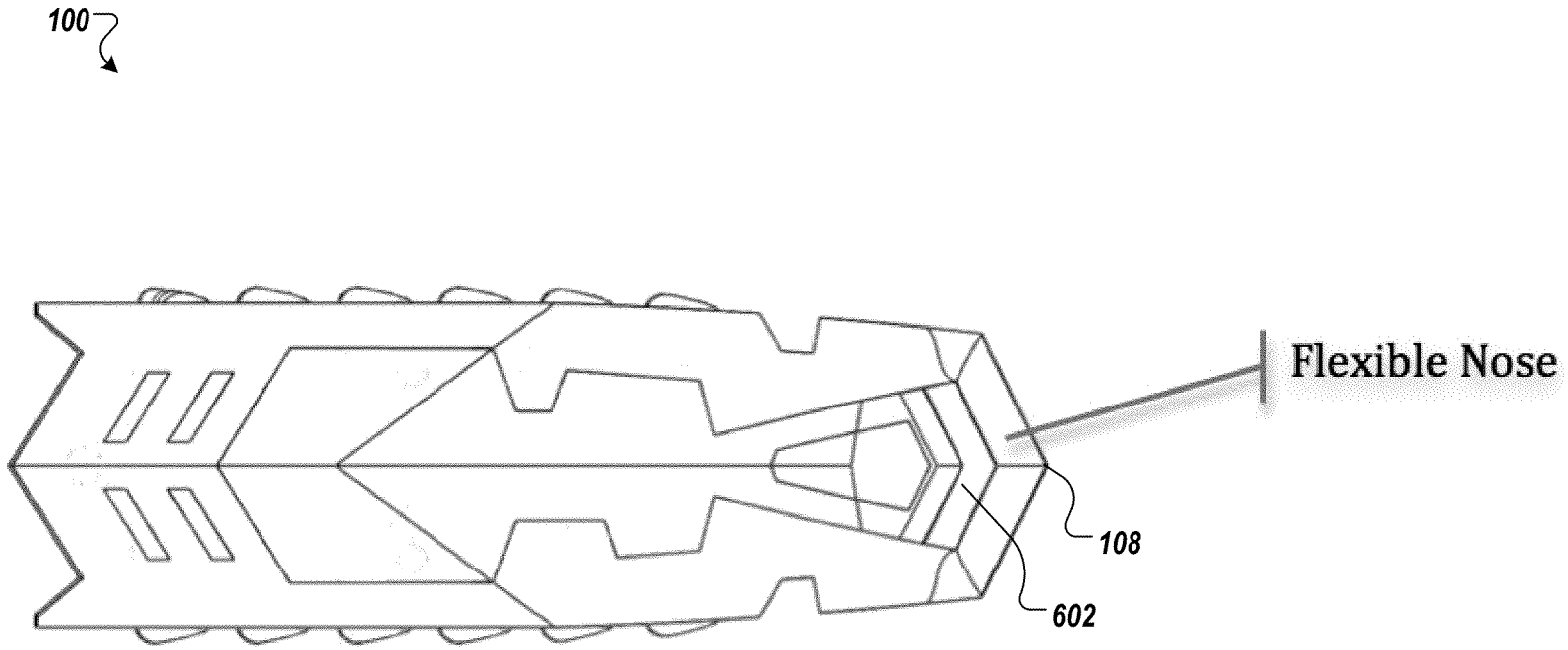
FIG. 6 shows a top view of the device and its flexible nose.

FIG. 6 shows a top view of the vehicle 100 and further shows the flexible nose 108. Depending on the shape and resiliency of the nose 108, the vehicle 100 can more easily deflect off obstacles and remain upright, instead of tipping. The nose 108 can be constructed from rubber or some other relatively resilient material that allows the device to bounce off obstacles. Further, a spring or other device can be placed behind the surface of the nose 108 that can provide an extra bounce. A void or hollow space 602 behind the nose 108 can also contribute to the device's ability to deflect off of obstacles that are encountered nose-first.

Alternative Leg Configurations

Figure 3A:
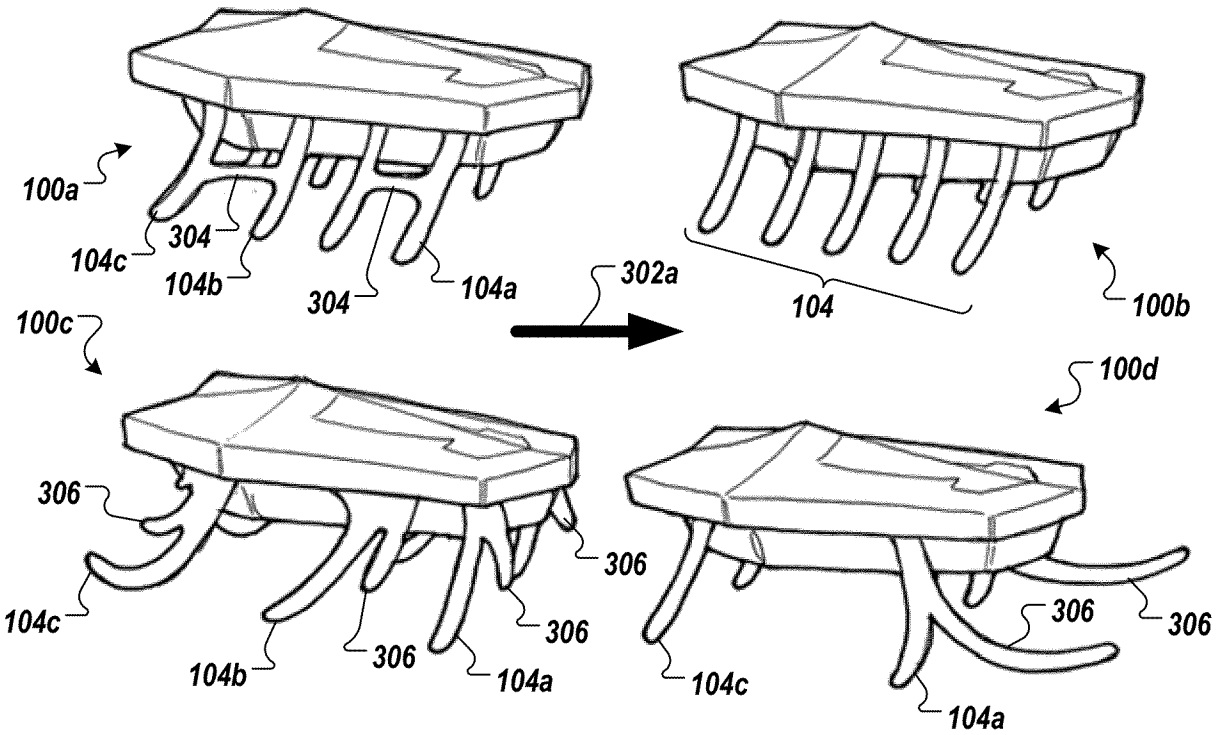
FIGS. 3A through 3C are diagrams that show various examples of alternative leg configurations for vibration powered devices.
Figure 3B:
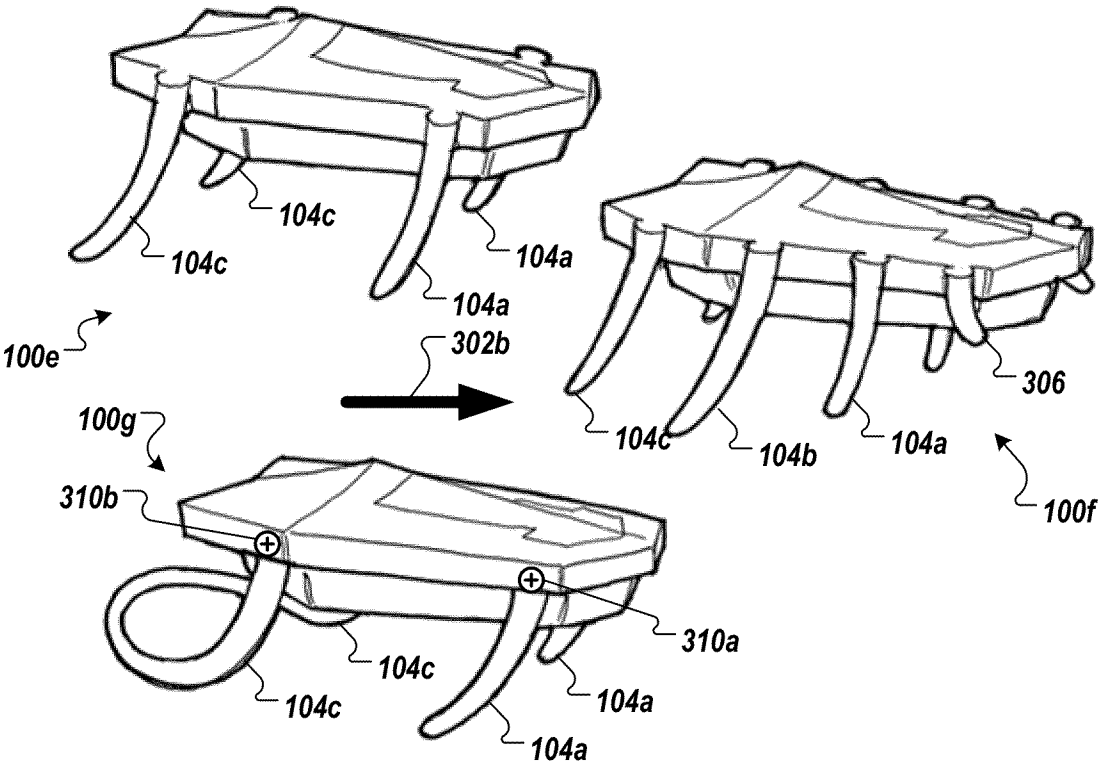
Figure 3C:
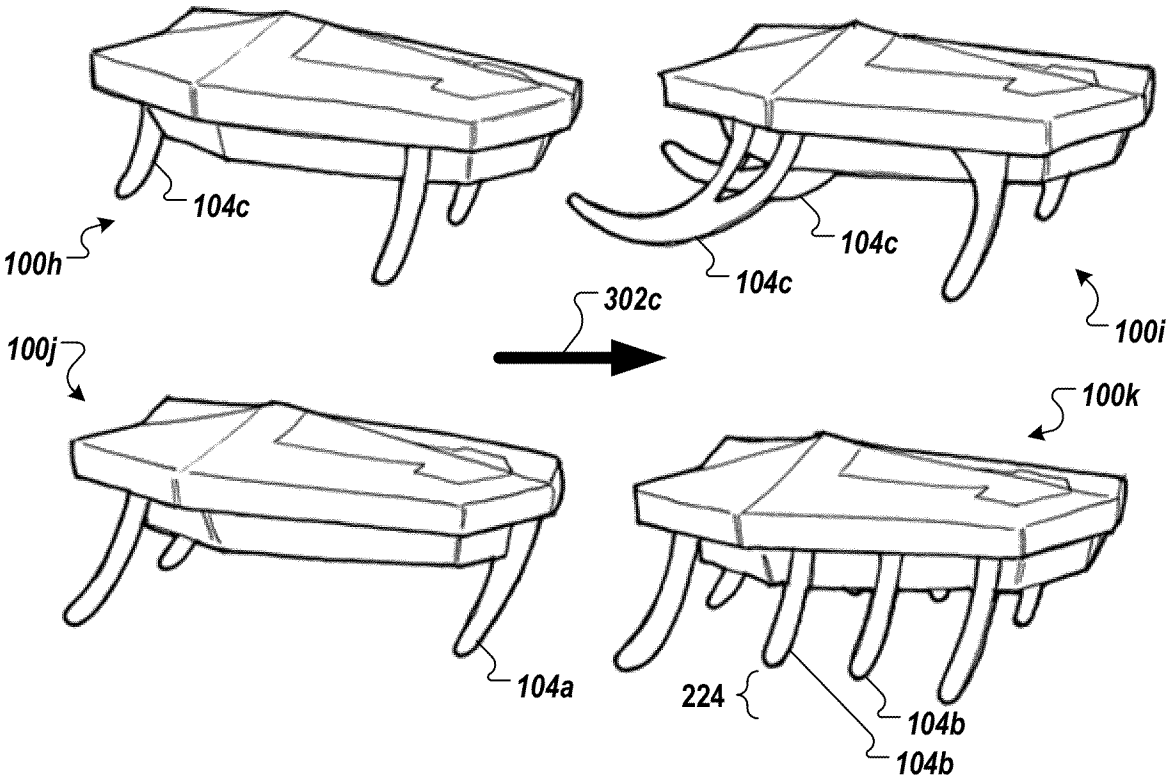

FIGS. 3A-3C show various examples of alternative leg configurations for devices 100*a*-100*k*. The devices 100*a*-100*k* primarily show leg 104 variations but can also include the components and features described above for the device 100. As depicted in FIGS. 3A-3C, the forward direction of movement is left-to-right for all of the devices 100*a*-100*k*, as indicated by direction arrows 302*a*-302*c*. The device 100*a* shows legs connected with webs 304. The webs 304 can serve to increase the stiffness of the legs 104 while maintaining legs 104 that appear long. The webs 304 can be anywhere along the legs 104 from the top (or base) to the bottom (or tip). Adjusting these webs 304 differently or on the device's right versus the left can serve to change leg characteristics without adjusting leg length and provide an alternate method of correcting steering. The device 100*b* shows a common configuration with multiple curved legs 104. In this implementation, the middle legs 104*b* may not touch the ground, which can make production tuning of the legs easier by eliminating unneeded legs from consideration. Devices 100*c* and 100*d* show additional appendages 306 that can add an additional life-like appearance to the devices 100*c* and 100*d*. The appendages 306 on the front legs can resonate as the devices 100*c* and 100*d* move. As described above, adjusting these appendages 306 to create a desired resonance can serve to increase randomness in motion.

Additional leg configurations are shown in FIG. 3B. The devices 100*e* and 100*f* show leg connections to the body that can be at various locations compared to the devices 100*a*-100*d* in FIG. 3A. Aside from aesthetic differences, connecting the legs 104 higher on the device's body can serve to make the legs 104 appear to be longer without raising the CG. Longer legs 104 generally have a reduced stiffness that can reduce hopping, among other characteristics. The device 100*f* also includes front appendages 306. The device 100*g* shows an alternate rear leg configuration where the two rear legs 104 are connected, forming a loop.

Additional leg configurations are shown in FIG. 3C. The device 100*h* shows the minimum number of (e.g., three) legs 104. Positioning the rear leg 104 right or left acts as a rudder changing the steering of the device 100*h*. Using a rear leg 104 made of a low friction material can increase the device's speed as previously described. The device 100*j* is three-legged device with the single leg 104 at the front. Steering can be adjusted on the rear legs by moving one forward of the other. The device 100*i* includes significantly altered rear legs 104 that make the device 100*i* appear more like a grasshopper. These legs 104 can function similar to legs 104 on the device 100*k*, where the middle legs 104*b* are raised and function only aesthetically until they work in self-righting the device 100*k* during a rollover situation.

In some implementations, devices 100 can include adjustment features, such as adjustable legs 104. For example, if a consumer purchases a set of devices 100 that all have the same style (e.g., an ant), the consumer may want to make some or all of the devices 100 move in varying ways. In some implementations, the consumer can lengthen or shorten individual leg 104 by first loosening a screw (or clip) that holds the leg 104 in place. The consumer can then slide the leg 104 up or down and retighten the screw (or clip). For example, referring for FIG. 3B, screws 310*a* and 310*b* can be loosened for repositioning legs 104*a* and 104*c*, and then tightened again when the legs are in the desired place.

In some implementations, screw-like threaded ends on leg bases 106*b* along with corresponding threaded holes in the device housing 102 can provide an adjustment mechanism for making the legs 104 longer or shorter. For example, by turning the front legs 104*a* to change the vertical position of the legs bases 106*b* (i.e., in the same way that turning a screw in a threaded hole changes the position of the screw), the consumer can change the length of the front legs 104*a*, thus altering the behavior of the device 100.

In some implementations, the leg base 106*b* ends of adjustable legs 104 can be mounted within holes in housing 102 of the device 100. The material (e.g., rubber) from which the legs are constructed along with the size and material of the holes in the housing 102 can provide sufficient friction to hold the legs 104 in position, while still allowing the legs to be pushed or pulled through the holes to new adjusted positions.

In some implementations, in addition to using adjustable legs 104, variations in movement can be achieved by slightly changing the CG, which can serve to alter the effect of the vibration of the motor 202. This can have the effect of making the device move slower or faster, as well as changing the device's tendency to turn. Providing the consumer with adjustment options can allow different devices 100 to move differently.

Device Dimensions

Figure 7B:
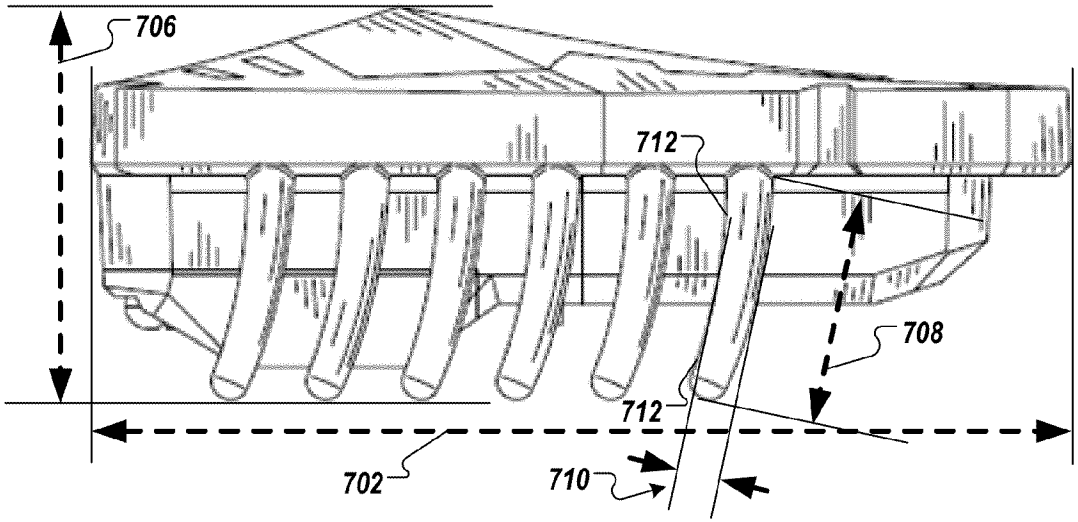
FIGS. 7A and 7B show example dimensions of the device.
Figure 7A:
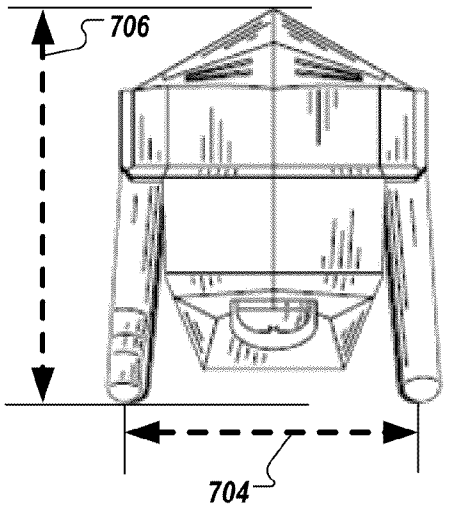

FIGS. 7A and 7B show example dimensions of the device 100. For example, a length 702 is approximately 1.73 inches, a width 704 from leg tip to leg tip is approximately 0.5 inches, and a height 706 is approximately 0.681 inches. A leg length 708 can be approximately 0.4 inches, and a leg diameter 710 can be approximately 0.077 inches. A radius of curvature (shown generally at 712) can be approximately 1.94 inches. Other dimensions can also be used. In general, the device length 702 can be in the range from two to five times the width 704 and the height 706 can be in the approximate range from one to two times the width 704. The leg length 708 can be in the range of three to ten times the leg diameter 710. There is no physical limit to the overall size that the device 100 can be scaled to, as long as motor and counterweight forces are scaled appropriately. In general, it may be beneficial to use dimensions substantially proportional to the illustrated dimensions. Such proportions may provide various benefits, including enhancing the ability of the device 100 to right itself after tipping and facilitating desirable movement characteristics (e.g., tendency to travel in a straight line, etc.).

Construction Materials

Material selection for the legs is based on several factors that affect performance. The materials main parameters are coefficient of friction (COF), flexibility and resilience. These parameters in combination with the shape and length of the leg affect speed and the ability to control the direction of the device.

COF can be significant in controlling the direction and movement of the device. The COF is generally high enough to provide resistance to sideways movement (e.g., drifting or floating) while the apparatus is moving forward. In particular, the COF of the leg tips (i.e., the portion of the legs that contact a support surface) can be sufficient to substantially eliminate drifting in a lateral direction (i.e., substantially perpendicular to the direction of movement) that might otherwise result from the vibration induced by the rotating eccentric load. The COF can also be high enough to avoid significant slipping to provide forward movement when $F_v$ is down and the legs provide a forward push. For example, as the legs bend toward the back of the device 100 (e.g., away from the direction of movement) due to the net downward force on the one or more driving legs (or other legs) induced by the rotation of the eccentric load, the COF is sufficient to prevent substantial slipping between the leg tip and the support surface. In another situation, the COF can be low enough to allow the legs to slide (if contacting the ground) back to their normal position when $F_v$ is positive. For example, the COF is sufficient low that, as the net forces on the device 100 tend to cause the device to hop, the resiliency of the legs 104 cause the legs to tend to return to a neutral position without inducing a sufficient force opposite the direction of movement to overcome either or both of a frictional force between one or more of the other legs (e.g., back legs 104*c*) in contact with the support surface or momentum of the device 100 resulting from the forward movement of the device 100. In some instances, the one or more driving legs 104*a* can leave (i.e., hop completely off) the support surface, which allows the driving legs to return to a neutral position without generating a backward frictional force. Nonetheless, the driving legs 104*a* may not leave the support surface every time the device 100 hops and/or the legs 104 may begin to slide forward before the legs leave the surface. In such cases, the legs 104 may move forward without causing a significant backward force that overcomes the forward momentum of the device 100.

Flexibility and resilience are generally selected to provide desired leg movement and hop. Flexibility of the leg can allow the legs to bend and compress when $F_v$ is down and the nose moves down. Resilience of the material can provide an ability to release the energy absorbed by bending and compression, increasing the forward movement speed. The material can also avoid plastic deformation while flexing.

Rubber is an example of one type of material that can meet these criteria, however, other materials (e.g., other elastomers) may a have similar properties.

Figure 8:
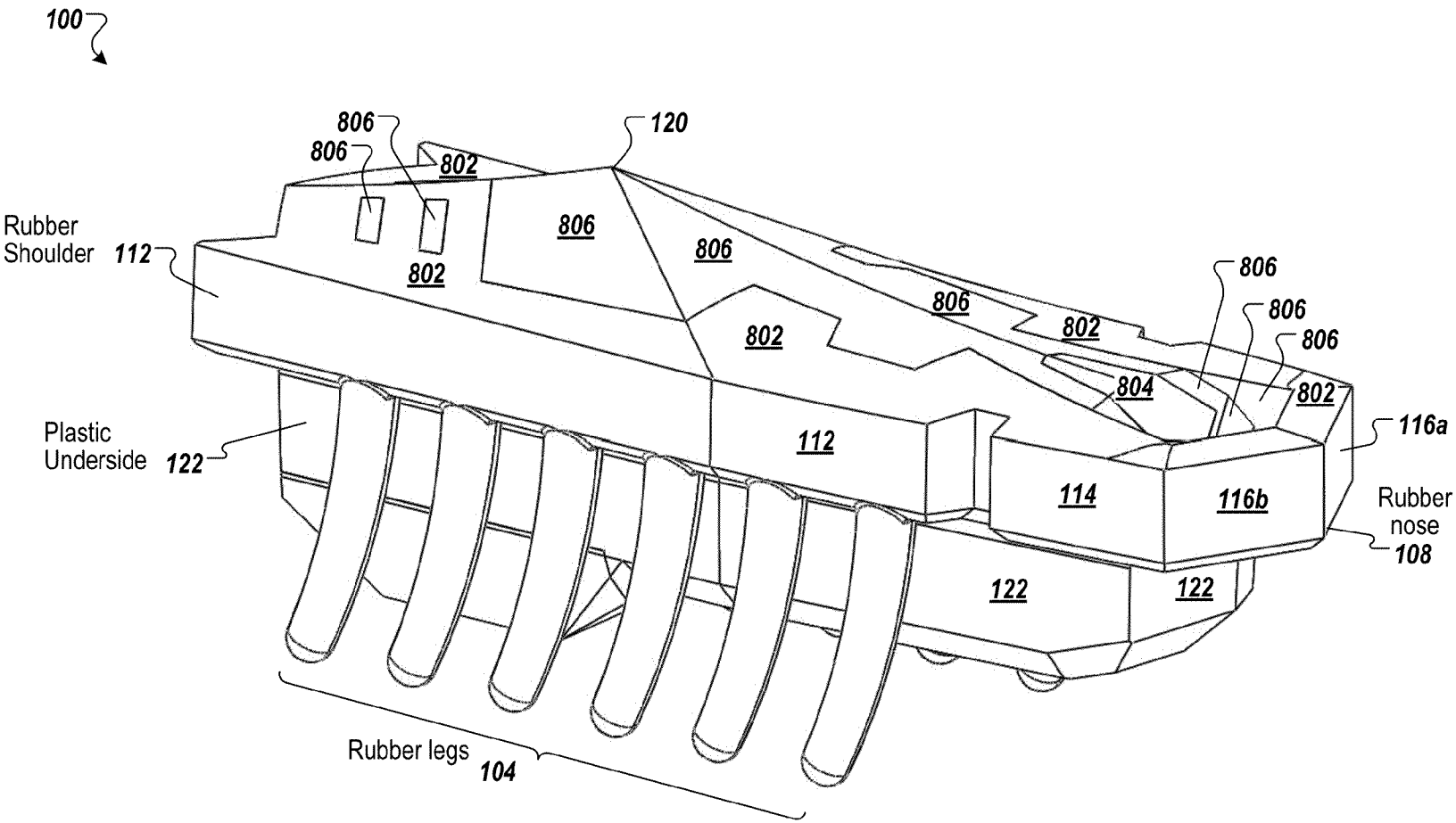
FIG. 8 shows one example configuration of example materials from which the device can be constructed.

FIG. 8 shows example materials that can be used for the device 100. In the example implementation of the device 100 shown in FIG. 8, the legs 104 are molded from rubber or another elastomer. The legs 104 can be injection molded such that multiple legs are integrally molded substantially simultaneously (e.g., as part of the same mold). The legs 104 can be part of a continuous or integral piece of rubber that also forms the nose 108 (including nose sides 116*a* and 116*b*), the body shoulder 112, and the head side surface 114. As shown, the integral piece of rubber extends above the body shoulder 112 and the head side surface 114 to regions 802, partially covering the top surface of the device 100. For example, the integral rubber portion of the device 100 can be formed and attached (i.e., co-molded during the manufacturing process) over a plastic top of the device 100, exposing areas of the top that are indicated by plastic regions 806, such that the body forms an integrally co-molded piece. The high point 120 is formed by the uppermost plastic regions 806. One or more rubber regions 804, separate from the continuous rubber piece that includes the legs 104, can cover portions of the plastic regions 806. In general, the rubber regions 802 and 804 can be a different color than plastic regions 806, which can provide a visually distinct look to the device 100. In some implementations, the patterns formed by the various regions 802-806 can form patterns that make the device look like a bug or other animate object. In some implementations, different patterns of materials and colors can be used to make the device 100 resemble different types of bugs or other objects. In some implementations, a tail (e.g., made of string) can be attached to the back end of the device 100 to make the device appear to be a small rodent.

The selection of materials used (e.g., elastomer, rubber, plastic, etc.) can have a significant effect on the vehicle's ability to self-right. For example, rubber legs 104 can bend inward when the device 100 is rolling during the time it is self-righting. Moreover, rubber legs 104 can have sufficient resiliency to bend during operation of the vehicle 100, including flexing in response to the motion of (and forces created by) the eccentric load rotated by the motor 202. Furthermore, the tips of the legs 104, also being made of rubber, can have a coefficient of friction that allows the driving legs (e.g., the front legs 104) to push against the surface 110 without significantly slipping.

Using rubber for the nose 108 and shoulder 112 can also help the device 100 to self-right. For example, a material such as rubber, having higher elasticity and resiliency than hard plastic, for example, can help the nose 108 and shoulder 112 bounce, which facilitates self righting, by reducing resistance to rolling while the device 100 is airborne. In one example, if the device 100 is placed on its side while the motor 202 is running, and if the motor 202 and eccentric load are positioned near the nose 108, the rubber surfaces of the nose 108 and shoulder 112 can cause at least the nose of the device 100 to bounce and lead to self-righting of the device 100.

In some implementations, the one or more rear legs 104*c* can have a different coefficient of friction than that of the front legs 104*a*. For example, the legs 104 in general can be made of different materials and can be attached to the device 100 as different pieces. In some implementations, the rear legs 104*c* can be part of a single molded rubber piece that includes all of the legs 104, and the rear legs 104*c* can be altered (e.g., dipped in a coating) to change their coefficient of friction.

While this specification contains many specific implementation details, these should not be construed as limitations on the scope of any inventions or of what may be claimed, but rather as descriptions of features specific to particular embodiments of particular inventions. Certain features that are described in this specification in the context of separate embodiments can also be implemented in combination in a single embodiment. Conversely, various features that are described in the context of a single embodiment can also be implemented in multiple embodiments separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination. Other alternative embodiments can also be implemented. For example, some implementations of the device 100 can omit the use of rubber. Some implementations of the device 100 can include components (e.g., made of plastic) that include glow-in-the-dark qualities so that the device 100 can be seen in a darkened room as it moves across the surface 110 (e.g., a kitchen floor). Some implementations of the device 100 can include a light (e.g., an LED bulb) that blinks intermittently as the device 100 travels across the surface 110.

Figure 10:
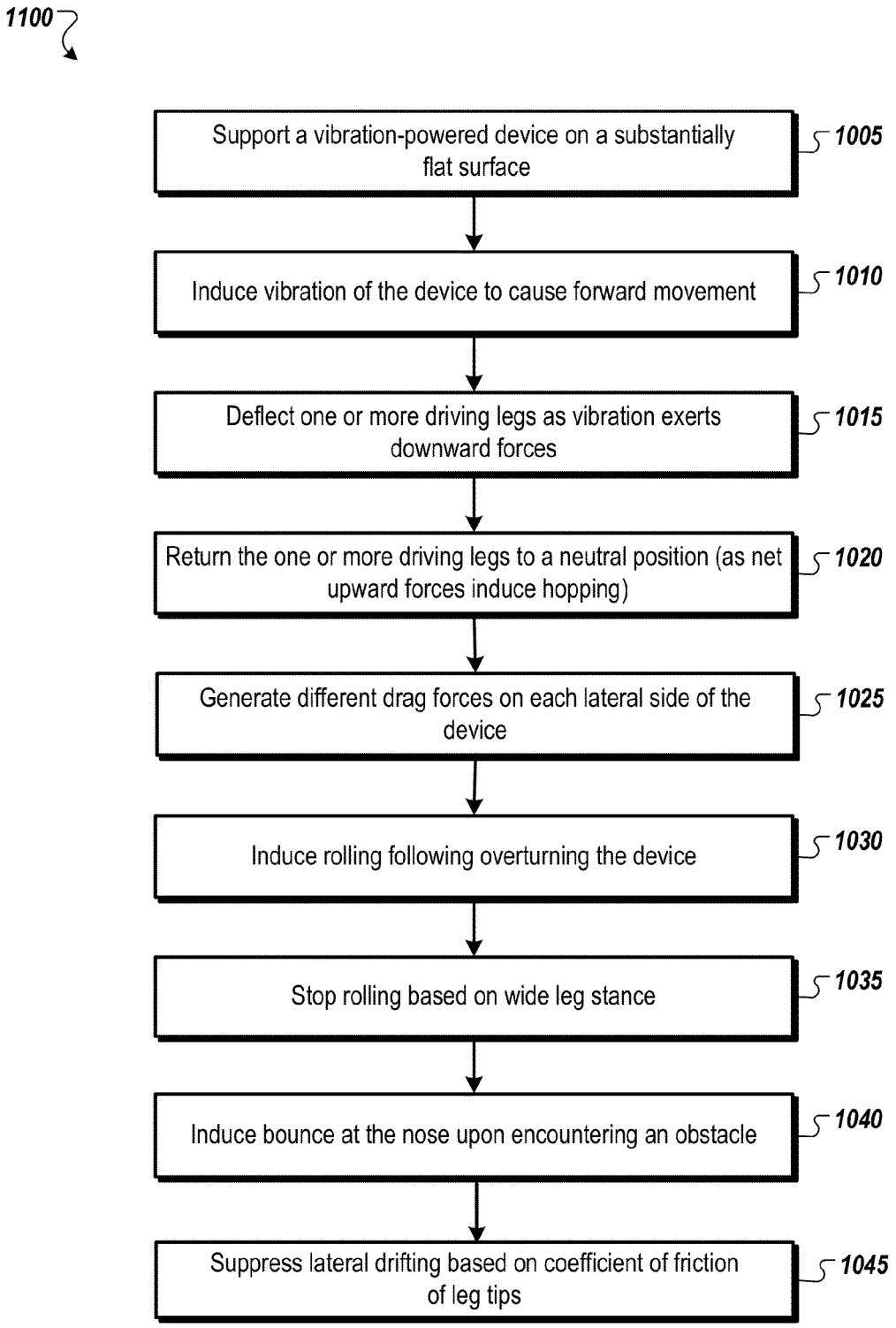
FIG. 10 is a flow diagram of a process for operating a vibration-powered device.

FIG. 10 is a flow diagram of a process 1000 for operating a vibration-powered device 100 (e.g., a device that includes any appropriate combination of the features described above). The device can include any appropriate combination of features, as described above. In various embodiments, different subsets of the features described above can be included.

Initially, a vibration-powered device is placed on a substantially flat surface at 1005. Vibration of the device is induced at 1010 to cause forward movement. For example, vibration may be induced using a rotational motor (e.g., battery powered or wind up) that rotates a counterweight. The vibration can induce movement in a direction corresponding to an offset between the leg bases and the leg tips of one or more driving legs (i.e., the forward direction). In particular, this vibration can cause resilient legs to bend in one direction, at 1015, as the net downward forces cause the device to move downward. This bending, along with using a material with a sufficiently high coefficient of friction to avoid substantial slipping, can cause the device to move generally forward.

As the vibration causes net upward forces (e.g., due to the vector sum of the forces induced by the rotating counterweight and the spring effect of the resilient legs) that cause the driving legs to leave the surface or to come close to leaving the surface, the tips of the one or more driving legs move in the forward direction (i.e., the leg deflects in the forward direction to return to a neutral position) at 1020. In some implementations, the one or more driving legs can leave the surface at varying intervals. For example, the driving legs may not leave the surface every time the net forces are upward because the forces may not overcome a downward momentum from a previous hop. In addition, the amount of time the driving legs leave the surface may vary for different hops (e.g., depending on the height of the hop, which in turn may depend on the degree to which the rotation of the counterweight is in phase with the spring of the legs).

During the forward motion of the device, different drag forces on each lateral side of the device can be generated at 1025. Generally, these different drag forces can be generated by rear legs that tend to drag (or at least that drag more than front driving legs) and alter the turning characteristics of the device (e.g., to counteract or enhance turning tendencies). Typically, the legs can be arranged in (e.g., two) rows along each lateral side of the device, such that one or more of the legs in one row drag more than corresponding legs in another row. Different techniques for causing the device to generate these different drag forces are described above.

If the device overturns, rolling of the device is induced at 1030. In general, this rolling tendency can be induced by the rotation of the counterweight and causes the device to tend to independently right itself. As discussed above, the outer shape of the device along the longitudinal dimension (e.g., substantially parallel to the axis of rotation and/or the general forward direction of movement of the device) can be shaped to promote rolling (e.g., by emulating longitudinal "roundness"). Rolling of the device can also be stopped by a relatively wide spread between the rows of legs at 1035. In particular, if the legs are wide enough relative to the COG of the device, the rotational forces generated by the rotating counterweight are generally insufficient (absent additional forces) to cause the device to roll over from the upright position.

At 1040, resiliency of the nose of the device can induce a bounce when the device encounters an obstacle (e.g., a wall). This tendency to bounce can facilitate changing directions to turn away from an obstacle or toward a higher angle of incidence, particularly when combined with a pointed shaped nose as discussed above. The resilient nose can be constructed from a elastomeric material and can be integrally molded along with lateral shoulders and/or legs using the same elastomeric material. Finally, lateral drifting can be suppressed at 1045 based on a sufficiently high coefficient of friction at the leg tips, which can prevent the legs from tending to slide laterally as the rotating counterweight generates lateral forces.

Figure 11:
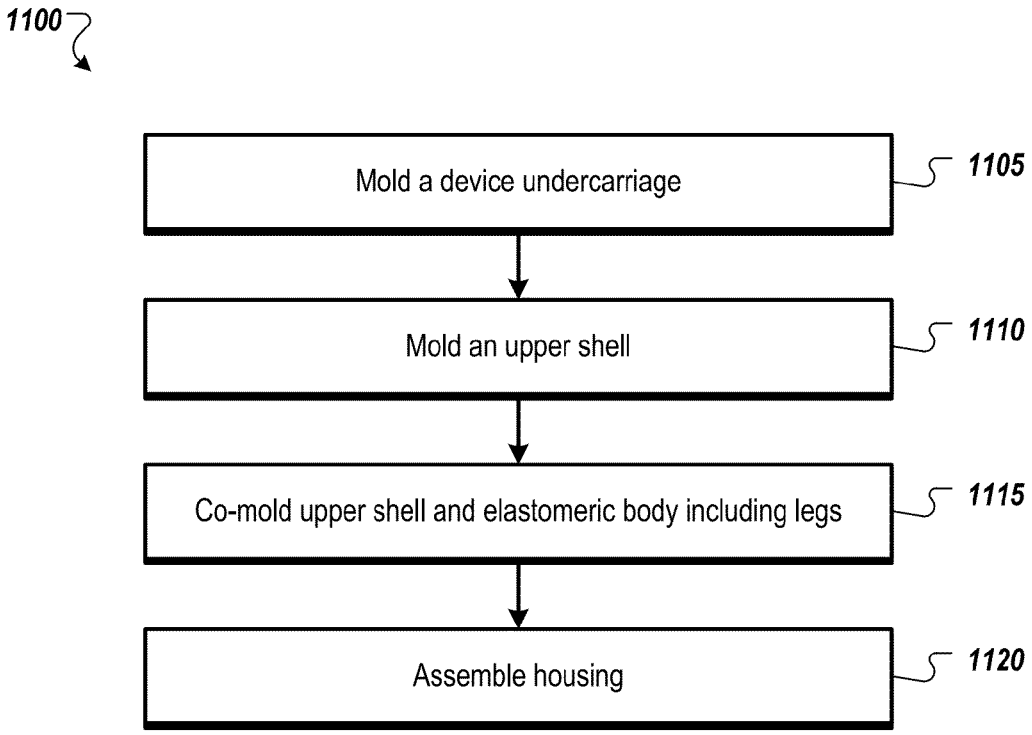
FIG. 11 is a flow diagram of a process for constructing a vibration-powered device.

FIG. 11 is a flow diagram of a process 1100 for constructing a vibration-powered device 100 (e.g., a device that includes any appropriate combination of the features described above). Initially, the device undercarriage is molded at 1105. The device undercarriage can be the underside 122 shown in FIG. 1 and can be constructed from a hard plastic or other relatively hard or stiff material, although the type of material used for the underside is generally not particularly critical to the operation of the device. An upper shell is also molded at 1110. The upper shell can include a relatively hard portion of the upper body portion of the housing 102 shown in FIG. 1, including the high point 120. The upper shell is co-molded with an elastomeric body at 1115 to form the device upper body. The elastomeric body can include a single integrally formed piece that includes legs 104, shoulders 112, and nose 108. Co-molding a hard upper shell and a more resilient elastomeric body can provide better constructability (e.g., the hard portion can make it easier to attach to the device undercarriage using screws or posts), provide more longitudinal stiffness, can facilitate self-righting (as explained above), and can provide legs that facilitate hopping, forward movement, and turning adjustments. The housing is assembled at 1120. The housing generally includes a battery, a switch, a rotational motor, and an eccentric load, which may all be enclosed between the device undercarriage and the upper body.

In certain circumstances, it may be desirable to demonstrate at least some of the operative features of the vibration-powered device. For example, a retailer may wish to display a vibration-powered device within a retail store. However, as with any battery-powered (or wind-up) device, the operational time of a vibration-powered device is limited, so displaying the vehicle in operation at a store is difficult when the battery life is only a few hours. In particular, displaying movement characteristics using internal batteries of the device would require someone to change batteries many times a day, and power cords connected to the vehicles are generally not feasible.

Instead of relying on vibrating mechanisms (e.g., a rotational coupled to an eccentric load) internal to the device, it is possible to vibrate a floor (e.g., of a display case) to achieve similar movement of the device. Techniques for creating vibration based on electrical power include using a rotary motor with a counterweight attached to the floor, or relying on axial movement from a speaker. Typically, in normal operation of the vibration-powered device, movement of the device is induced due to the vertical components of the counterweight as it is rotated by the rotational motor. Because, the side-to-side components are not required to induce forward motion, a speaker that is mounted to a fixed object with a platform attached to the speaker cone can create a suitable vibrating surface (e.g., a vibrating table). Similarly, attaching a rotary motor coupled to a counterweight to the platform can induce similar movement in the vertical direction, especially if the platform is restricted from lateral or horizontal movement. Thus, the speaker or other source of vibration can be used to induce motion in a vibration-powered device that rests on the vibrating surface.

Using a speaker cone may have certain benefits over alternative vibrating mechanisms. For example, the speaker can adapt to the specific needs of the vibration-powered device, in that adjusting the vibration and amplitude of the speaker can be accomplished with a simple amplifier circuit, allowing independent adjustment of frequency and amplitude. On the other hand, adjusting the amplitude and frequency using a motor are inter-related with the mass of the counter weight, the speed of the motor, and the performance characteristics of the motor. Increasing motor speed alone increases both the frequency and the amplitude. Increasing the offset weight of the counterweight increases the amplitude and decreases the frequency. Both of these adjustments also need to be managed within the limits of the motors non-linear power output. These inter-related and non-linear factors make tuning the platform to the device much more complex, and require mechanical and electrical changes to accomplish the task.

The speaker has an additional power consumption benefit, based on the efficiency of the speaker compared to a motor. One contributing factor to the differences in power consumption is the fact that the entire motor needs to be affixed to the platform, requiring that the motor and counterweight create forces sufficient to move the weight of both the platform and motor combined. With a speaker, only the relatively low weight paper or plastic cone needs to move in addition to the platform.

Power can be provided for use in inducing vibration using either AC power or batteries (i.e., DC power). At many stores, AC power is not present at the product shelves. The use of battery power that lasts for one to three months, on the other hand, requires very low power consumption. In addition to using either AC or DC power, the power source can include an intermediate circuit that provides a selected voltage peak-to-peak level necessary to generated the desired amplitude. In this specification, however, the power source can include the initial AC or DC power source, the intermediate circuit, or both. In some implementations, the intermediate circuit can include an adjustable control (e.g., a knob, dial, or multi-level switch) to enable users (e.g., store personnel) to adjust the voltage level.

Figure 12:
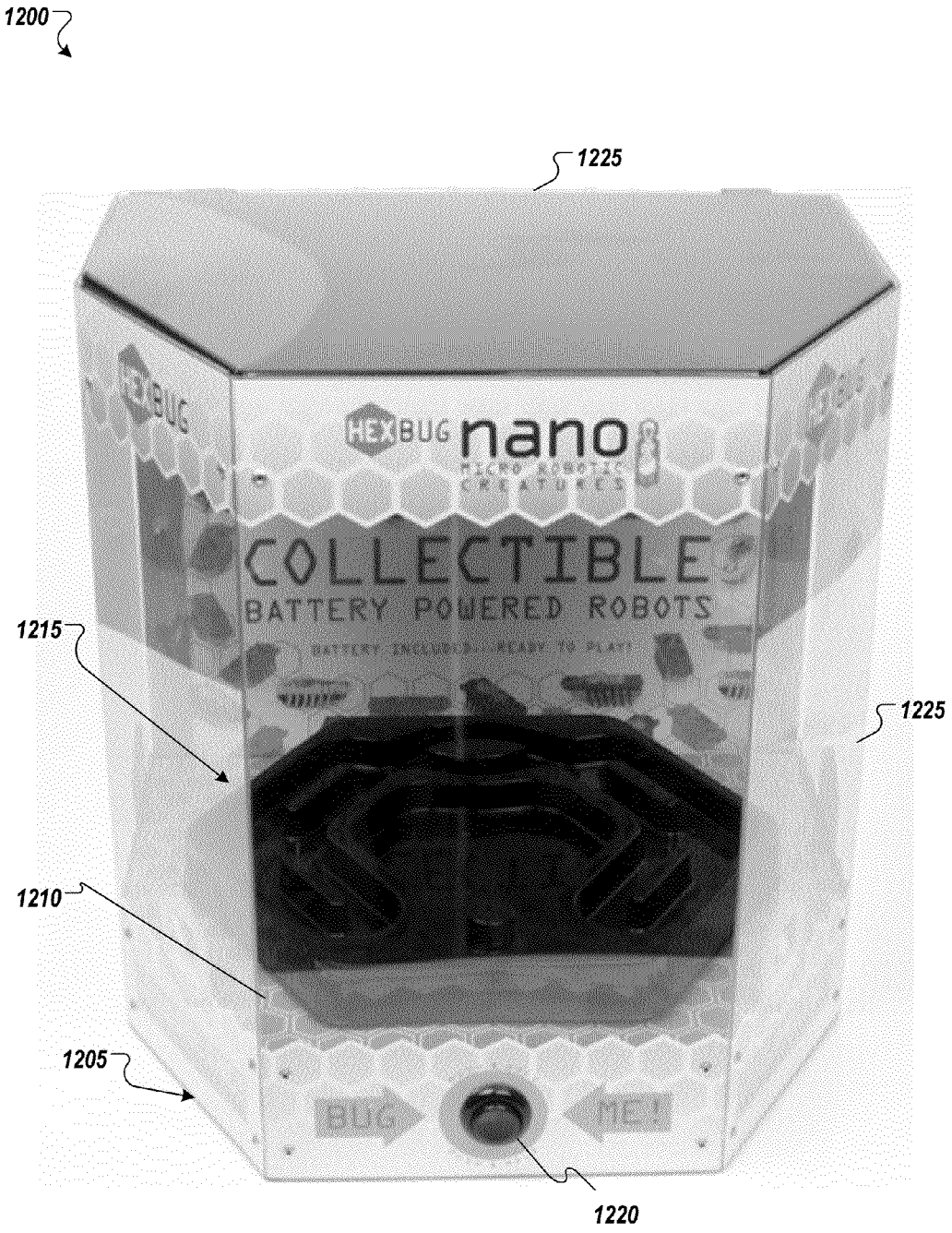
FIG. 12 shows a display case for inducing motion of a vibration-powered vehicle.

FIG. 12 shows a display case 1200 for inducing motion of a vibration-powered vehicle. The display case 1200 can include a fixed base 1205 and a platform 1210 supported by the fixed base 1205. The platform 1210 is typically at least substantially planar and can further support one or more obstacles 1215 (e.g., a maze, posts, walls, or other obstacles). The display case 1200 includes a customer-accessible button 1220 to initiate vibration and thus start motion of any vibration-powered devices placed in an upright position on the platform 1210. The display case 1200, as depicted also includes an outer cover 1225 that is generally at least partially transparent to allow viewing of the devices in the display case 1200.

In some implementations, a speaker provides a source for vibration, although other vibration-inducing mechanisms (e.g., a motor attached to a crank or a motor attached to a counterweight) can alternatively be used. A speaker can be controlled to vary the amplitude and frequency of speaker vibration. In some implementations, the speaker vibration frequency is tuned to closely match an internal motor rotation frequency of the vibration-powered device. In addition, the speaker amplitude can be adjusted to simulate the inertia induced load of the eccentric load coupled to the internal motor of the device. For example, the vibration amplitude can be set in a range of 4 to 10 volts peak to peak. The vibration mechanism of the display case can be designed to consume less than 250 milliamps (or in some cases less than 20 mA) within this range. In some cases, the vibration amplitude can be selected depending on the particular configuration of the display case 1200 and/or the number of vibration-powered devices in the display case 1200. When the configuration shown in FIG. 12 contains two vehicles such as that shown in FIG. 1, the voltage may be selected at approximately 5.0 volts peak to peak. In some implementations, the display case 1200 can include independently adjustable frequency and amplitude controls (e.g., dials or multi-position switches) that can be adjusted on a particular installation basis and over time. For the vehicle shown in FIG. 1, the frequency used to induce motion can be in the range of about 40 Hz to about 200 Hz. In one example embodiment, the frequency is set to about 53 Hz. In some embodiments, the frequency of the speaker can be selected to approximately match a motor rotation frequency of the vibration-powered vehicle.

In normal operation and as discussed above, the rotating eccentric load internal to the vibration-powered device contributes to an ability for the device to self-right, such that the device ends up on its legs in an upright position. A vibrating table does not provide the same angular forces on the device as an internal rotating eccentric load. In some implementations, therefore, it is desirable to prevent devices on the platform from tipping over. One way to prevent tipping is to place a cover over the vibrating platform. Generally, such a cover can have a geometry that prevents the device from tipping onto its side or back. For example, the cover can be situated approximately parallel to the platform and spaced apart from the platform at a great enough distance to allow the vibration-powered vehicle to move across the platform and at a low enough distance to deter or prevent the vibration-powered vehicle from turning over. The cover can be at least substantially planar and at least substantially transparent.

Figure 13:
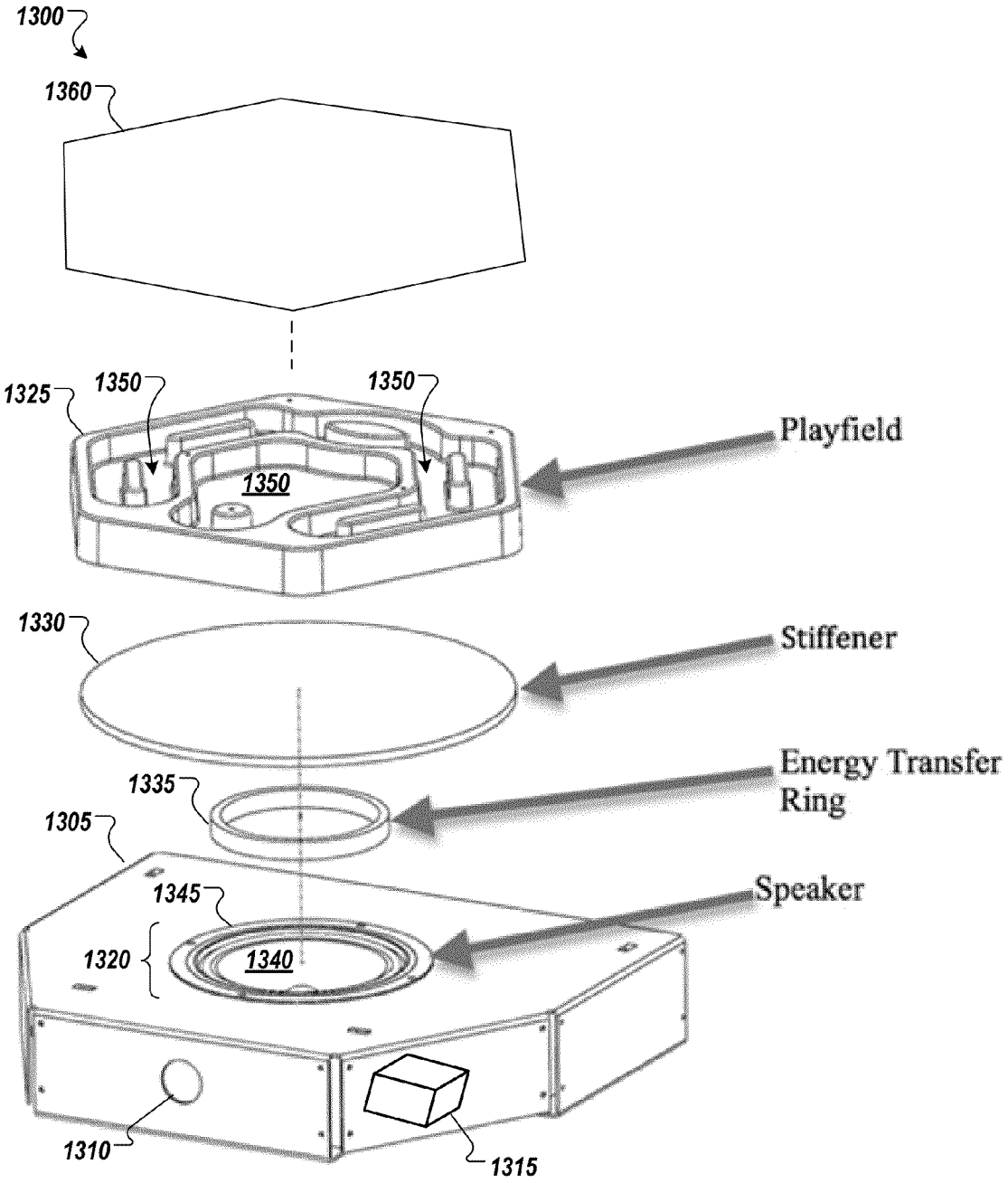
FIG. 13 depicts an exploded view of at least a portion of a display case similar to the display case shown in FIG. 12.

FIG. 13 depicts an exploded view of at least a portion of a display case 1300 similar to the display case 1200 shown in FIG. 12. The display case 1300 includes a fixed base 1305, which is illustrated as including a hole 1310 (e.g., for the button 1220). Generally, the button can serve as a switch for applying power from a power source 1315 at a suitable amplitude and frequency to a speaker 1320. In some cases, power is applied only while the button is pushed while in other cases, the button activates a timer that causes power to be applied until expiration of the timer. As the fixed base 1305 rests on a store floor, a table, or other supporting structure, application of power can cause axial movement of the speaker 1320 in a vertical direction (i.e., perpendicular to the floor).

Energy from the speaker 1320 can be transferred to a playfield 1325 to simulate actual vehicle motion. This energy transfer can be accomplished using a playfield assembly that includes the playfield 1325 itself, a stiffener 1330, an energy transfer ring 1335, and the speaker 1320. In general, motion of the speaker 1320 is transferred by the energy transfer ring 1335 that is connected to the speaker, which is in turn connected to the stiffener 1330. The energy transfer ring 1335 can be used to transfer movement of the speaker 1320 to the stiffener 1330 and to the playfield 1325. The axially moveable region 1340 of the speaker is generally below an outer lip 1345 of the speaker, so the energy transfer ring 1335 serves to transfer movement of the moveable region 1340 to the stiffener 1330. The stiffener 1330 takes the focused motion from the energy transfer ring 1335 and spreads the motion to an area approximately the size of the playfield 1325. Thus, the stiffener 1330 can be used to prevent or generally minimize local deflections in the playfield 1325, which can cause the playfield 1325 to have locations where the vibration-powered vehicles on the playfield 1325 seem dead. A floor 1350 of the playfield 1325 can serve as a vibrating platform that induces movement of the vehicles. The playfield 1325 can also include walls and obstacles 1355, which can be constructed from a very low friction material to allow the vehicles to slide along obstacles freely without internal power and have features that enhance the vehicle's apparent intelligence. A cover 1360 can rest on or be attached to the top of the playfield 1325 and can be spaced apart from the surface of the playfield 1325 at a sufficient distance to allow the vehicles to move freely but to prevent the vehicles from turning over.

Another technique for displaying the vehicle's capability over long periods of time is to utilize inductive charge technology to keep the vehicle operating on its own internal power.

Figure 14:
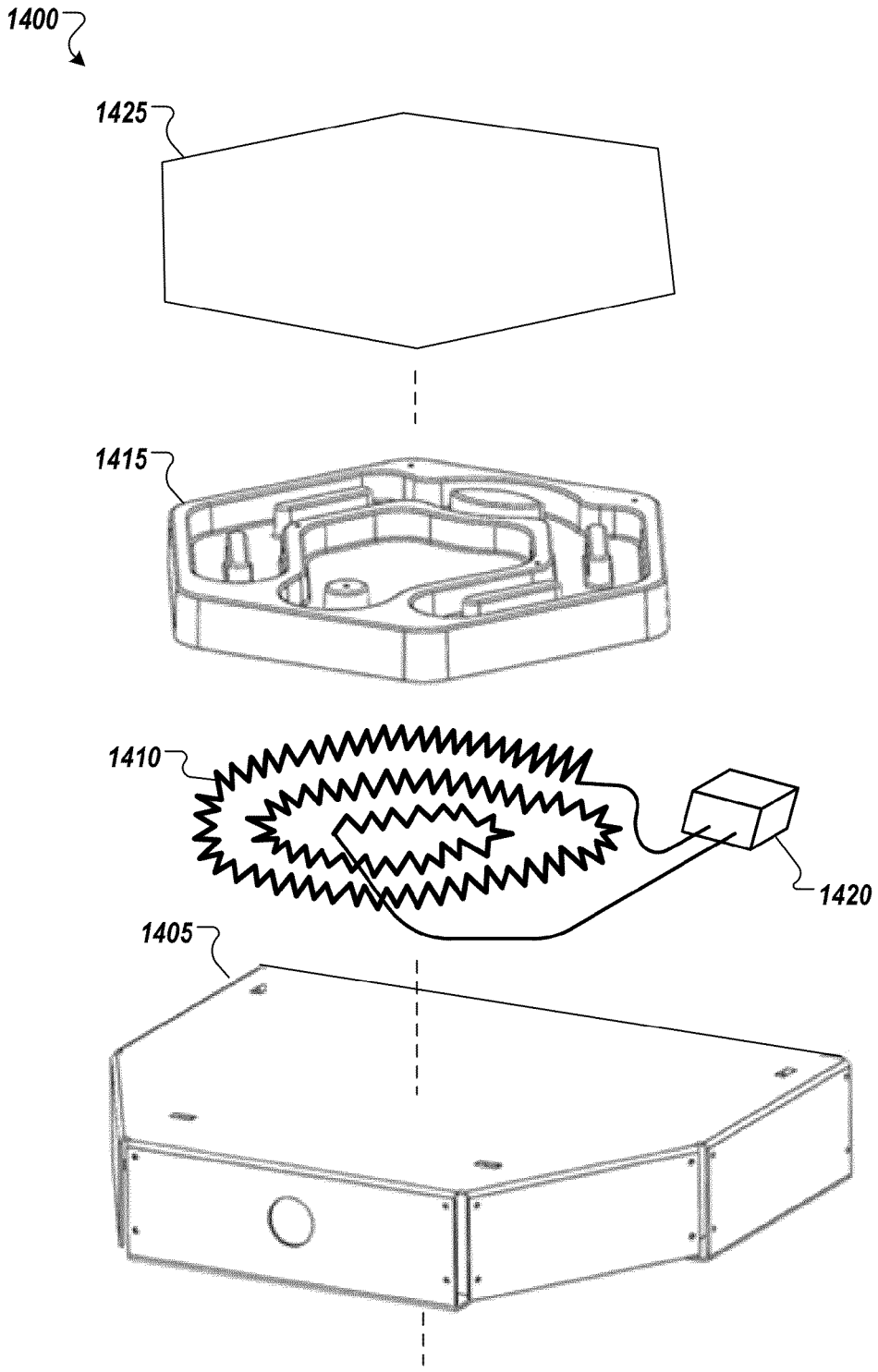
FIG. 14 depicts an exploded view of at least a portion of a display case that uses inductive charging to provide power to a vibration-powered device.

FIG. 14 depicts an exploded view of at least a portion of a display case 1400 that uses inductive charging to provide power to a vibration-powered device. The display case 1400 includes a fixed base 1405, a conductive wire 1410, a playfield 1415, and a power source 1420. The playfield 1415 conductive wire is coiled underneath the entire playfield surface. The conductive coil can be connected to the power source 1420, which may include AC or DC power and/or an intermediate circuit that conditions the AC or DC power as appropriate. The vehicle is outfitted with a similar, but smaller coil that is connected to a rechargeable battery (e.g., one end of the coil connected to the positive battery terminal and the other end of the coil connected to the negative battery terminal). Both the coil and battery are part of the vehicle interior and power the internal motor. The use of inductive charging allows the vehicle to operate on its internal power and to demonstrate bug features (e.g., movement, self-righting, etc.).

Figure 15:
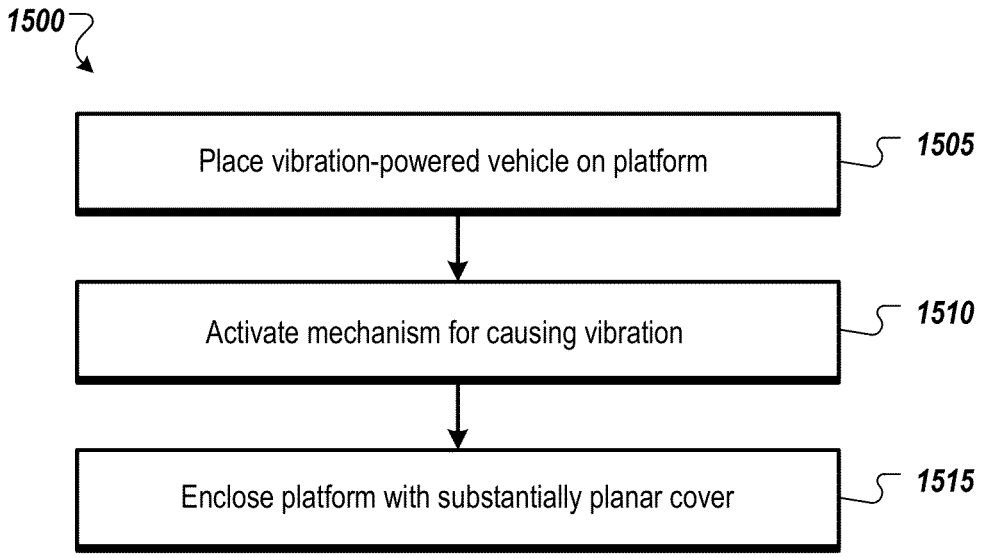
FIG. 15 is a flow chart of a process for inducing movement of a vibration-powered vehicle.

FIG. 15 is a flow chart 1500 of a process for inducing movement of a vibration-powered vehicle. A vibration-powered vehicle is placed on a platform at 1505. The platform is coupled to a mechanism for causing vibration (e.g., a speaker), which is in turn supported by a fixed base. The vibration-powered vehicle can include a self-contained vibration-inducing mechanism (e.g., a powered or wind-up rotational motor connected to an eccentric load). In some embodiments, however, the vibration-powered vehicle can be designed to include a self-contained vibration-inducing mechanism even if the self-contained vibration-inducing mechanism is not present. The mechanism for causing vibration is activated at 1510 (e.g., by providing power from a power source to the vibration mechanism), causing vibration of the platform. This vibration induces sufficient vibration of the vibration-powered vehicle to cause the vibration-powered vehicle to move across the platform without activation of the self-contained vibration-inducing mechanism. In some embodiments, an oscillation frequency of the mechanism for causing vibration can be tuned to substantially match a motor rotation frequency of the vibration-powered vehicle. The platform is enclosed with a substantially planar cover at 1515. The cover can be situated approximately parallel to the platform and spaced apart from the platform at a great enough distance to allow the vibration-powered vehicle to move across the platform and at a low enough distance to deter the vibration-powered vehicle from turning over.

Figure 16:
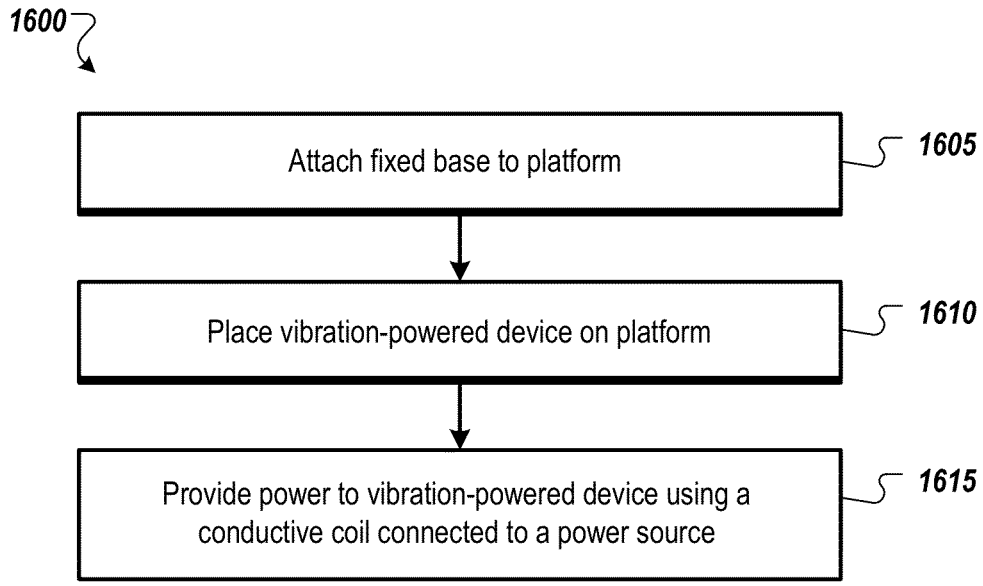
FIG. 16 is a flow chart of an alternative process for inducing movement of a vibration-powered vehicle.

FIG. 16 is a flow chart 1600 of an alternative process for inducing movement of a vibration-powered vehicle. A fixed base is attached to a platform at 1605, and a vibration-powered device is placed on the platform at 1610. Power is provided to the vibration-powered device using a conductive coil connected to a power source at 1615. The conductive coil is positioned under at least a portion of a surface of the platform, and the conductive coil is adapted to provide power to a conductive coil connected to the vibration-powered device. The power provided to the vibration-powered device is used to charge a battery on the vibration-powered device. In particular, electricity is supplied to charge the battery using the conductive coil connected to the power source and the conductive coil connected to the vibration-powered device.

Thus, particular embodiments of the subject matter have been described. Other embodiments are within the scope of the following claims.

What is claimed is:

1. A point of sale display to cause movement of a vibration-powered vehicle, the display comprising:

a fixed base;

a platform supported by the fixed base, the platform having a peripheral upper edge and a track positioned within the peripheral upper edge, and a vibration-powered vehicle positioned in the track;

a mechanism for causing vibration coupled to the platform and adapted to induce vibration of the platform sufficient to cause a vibration-powered vehicle to move across the platform; and a substantially planar cover situated approximately parallel to the platform and secured to the upper edge of the platform to prevent the removal of the vibration-powered vehicle when operable at a point of sale, the planar cover spaced apart from the platform at a great enough distance to allow the vibration-powered vehicle positioned between the planar cover and the platform to move across the platform and further spaced at a low enough distance to deter the vibration-powered vehicle from turning over.

2. The display of claim 1 further comprising:

a power source;

a speaker in communication with the power source, which when operable causes vibration of the platform;

an energy transfer ring coupled to the speaker;

a stiffener coupled between the energy transfer ring and the platform; and wherein the platform is configured to support the vibration-powered vehicle.

3. The display of claim 2, wherein the power source includes AC power.

4. The display of claim 2, wherein the power source includes a battery.

5. The display of claim 2, wherein the power source provides power to the speaker at an amplitude within a range of 4 to 10 volts peak to peak.

6. The display of claim 5, wherein the amplitude is approximately 5 volts peak to peak.

7. The display of claim 2, wherein the apparatus is tuned such that a frequency of the speaker is selected to approximately match a motor rotation frequency of the vibration-powered vehicle.

8. The display of claim 7, wherein the frequency of the speaker is in the range of 40 to 200 Hertz to induce motion of the vibration-powered vehicle.

9. The display of claim 2 further comprising a switch for controlling power supplied to the speaker.

10. The display of claim 1 wherein the substantially planar cover is substantially transparent.

* * * * *